US011614299B1

(12) United States Patent
Oglesby

(10) Patent No.: US 11,614,299 B1
(45) Date of Patent: Mar. 28, 2023

(54) OVER BARREL MUZZLE DEVICE ATTACHMENT SYSTEM

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 78 days.

(21) Appl. No.: 17/209,344

(22) Filed: Mar. 23, 2021

Related U.S. Application Data

(60) Provisional application No. 62/993,349, filed on Mar. 23, 2020.

(51) Int. Cl.
*F41A 21/32* (2006.01)
*F41A 5/26* (2006.01)

(52) U.S. Cl.
CPC ..... *F41A 21/325* (2013.01); *F41A 5/26* (2013.01)

(58) Field of Classification Search
CPC ..... F41A 21/32; F41A 21/325; F41A 21/00; F41A 5/26; F41A 5/28
USPC ..... 89/191.01, 191.02, 192, 193
See application file for complete search history.

(56) References Cited

U.S. PATENT DOCUMENTS 11,287,200 B1 * 3/2022 Oglesby ..... F41A 21/325
2011/0179945 A1 * 7/2011 Clark ..... F41A 5/18 89/193
2020/0025498 A1 * 1/2020 Wheeler ..... F41A 21/325

* cited by examiner

*Primary Examiner* — Jonathan C Weber
(74) *Attorney, Agent, or Firm* — Shaddock Law Group, PC

(57) ABSTRACT

An over barrel muzzle device attachment system including at least some of a gas block nut having a first externally threaded portion and a second externally threaded portion formed at a spaced apart location from the first externally threaded portion; a lock collar having a first internally threaded portion and a second internally threaded portion; a gas block lock ring having an at least partially internally threaded gas block lock ring aperture formed within at least a portion of a gas block lock ring aperture; a muzzle device adapter having a conical taper portion extending from an adapter muzzle end and a threaded portion extending along a portion of the muzzle device adapter, between the adapter muzzle end and an adapter barrel end; and an over barrel muzzle device having an externally threaded portion.

20 Claims, 17 Drawing Sheets

OVER BARREL MUZZLE DEVICE ATTACHMENT SYSTEM

CROSS-REFERENCE TO RELATED APPLICATIONS

This patent application claims the benefit of U.S. Patent Application No. 62/993,349, filed Mar. 23, 2020, the disclosure of which is incorporated herein in its entirety by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present disclosure relates to an over barrel muzzle device attachment system for a firearm.

2. Description of Related Art

A number of firearms operate based on a gas blowback system. One such firearm is the M-16, M-4, and AR-15 family of firearms.

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

During normal operation of a semiautomatic AR-15 style rifle, when a round is fired, gas from the burning propellant forces the bullet through the barrel. Before the bullet leaves the barrel, a portion of the gas enters a gas port in the upper part of the barrel under the front sight (or gas block). The gas port directs gas through a portion of the front sight (or gas block) and into the gas tube, which directs the gas into a cylinder between the bolt carrier and the bolt and drives the bolt carrier rearward.

The buffer, which is pushing on the rear of the bolt carrier group, is forced rearward by the bolt carrier group compressing the recoil spring. During this rearward movement, a cam track in the upper portion of the bolt carrier acts on the bolt cam pin, rotating the cam pin and bolt clockwise so that the bolt locking lugs are unlocked from the barrel extension locking lugs. As the rearward movement of the bolt carrier group continues, the empty cartridge case is extracted from the chamber, and ejected through the ejection port.

As the bolt carrier group clears the top of an inserted magazine and the empty cartridge case is expelled, a new round is pushed into the path of the bolt by the upward thrust of the magazine follower and spring.

As the bolt carrier group continues to move rearward, it overrides the hammer and forces the hammer down into the receiver, compressing the hammer spring, and allowing the rear hook of the hammer to engage with the hammer disconnect.

When the bolt carrier group reaches its rearmost position (when the rear of the buffer contacts the rear of the buffer tube), the compressed recoil spring expands, driving the buffer assembly forward with enough force to drive the bolt carrier group forward, toward the chamber, initiating chambering of the waiting round from the magazine into the chamber.

The forward movement of the bolt ceases when the locking lugs pass between the barrel extension locking lugs and the round is fully chambered. When the bolt carrier enters the final portion of its forward movement, the bolt cam pin emerges from the cam pin guide channel in the upper receiver and moves along the cam track, rotating the bolt counterclockwise. This rotation locks the bolt to the barrel extension (by interaction of the bolt locking lugs and the barrel extension locking lugs). The locking of the bolt completes the cycle of operation and, when the trigger is released, the rear hammer hook hammer slips from the disconnect and the front hammer hook is caught by the sear of the trigger. The firearm is then ready to be fired again.

A muzzle brake is a device that is attached to the terminal end of a muzzle of a firearm that redirects propellant gases to counter recoil and unwanted barrel rise that normally occurs during the normal firing sequence. Muzzle brakes or other devices are typically attached to a firearm barrel via interaction between internal threads of the muzzle device and external threads at the muzzle end of the barrel.

During normal operation of a firearm, and particularly a rifle, when a round is fired, gas from the burning propellant forces the bullet through the barrel. As the bullet travels down and out of the barrel, the bullet and the propellant gases act on barrel, along the longitudinal axis, or centerline, of the barrel, to produce a recoil force. Because of the difference between the longitudinal axis of the barrel and the average point of contact between the firearm and the user (the average point where the user resists the recoil force), the muzzle end of the firearm's barrel rotates upward.

Muzzle brakes typically utilize one or more slots, vents, holes, and/or baffles to divert and/or redirect the propellant gases as they leave the barrel. Generally, muzzle brakes divert and/or redirect the propellant gases horizontally (left and right), at some angle that is substantially perpendicular to the longitudinal axis of the barrel.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Unfortunately, the typical attachment of a muzzle device to a barrel via direct interaction between internal threads of the muzzle device and external threads of the barrel is not ideal.

The disadvantages and shortcomings of the prior art are overcome by the features and elements of the over barrel muzzle device attachment system of the present disclosure. For example, the present disclosure features a mounting surface that may be permanently attached to a barrel. The gas block not, locking collar, and gas block lock ring are all pre-assembled such that the lock collar is in a free-floating, rotating position between the threads of the gas block nut and the shoulder created by the gas block lock ring.

The gas block nut has external threads that allow the lock collar to be in a retracted or "parked" position when an over barrel muzzle device is not in use. The in the retracted position, the lock collar is threaded late attached or coupled to the gas block nut, so that the lock collar does not rattle or wander about.

When installing the system, the lock collar is unthreaded from its retracted or "parked" position, the over barrel muzzle device is inserted over the mounting surface (or muzzle device adapter), and engagement between the internal threads of the lock collar and external threads of the over barrel muzzle device secures the over barrel muzzle device to the mounting surface. The action of threading these two items together will cause the internal shoulder on the lock collar to be urged against the locking ring, stopping forward movement of the lock collar.

Continued tightening of the lock ring will draw the over barrel flash hider up onto the tapered surface of the mounting surface and engage the tapered surface of the inside of the over barrel flash hider.

The advantages of the present disclosure are optionally attained by providing, in an exemplary, nonlimiting embodiment, an over barrel muzzle device attachment system that includes at least some of a barrel extending from a barrel chamber end to a barrel muzzle end; a gas block nut formed of a gas block nut body, extending from a first gas block nut end to a second gas block nut end and having a gas block nut aperture extending therethrough, wherein a first externally threaded portion extending from the second gas block nut end, a second externally threaded portion formed at a spaced apart location from the first externally threaded portion, and an internally threaded portion extending from the first gas block nut end, within at least a portion of the gas block nut aperture; a lock collar formed of a lock collar body, extending from a first lock collar end to a second lock collar end and having a lock collar aperture extending therethrough, wherein a first internally threaded portion extending from a second lock collar end into at least a portion of a lock collar aperture and a second internally threaded portion extending from a first lock collar end into at least a portion of the lock collar aperture, wherein an internal lock collar shoulder is formed within a portion of the lock collar aperture, between the first internally threaded portion and the second internally threaded portion; a gas block lock ring having an at least partially internally threaded gas block lock ring aperture formed within at least a portion of a gas block lock ring aperture; a muzzle device adapter having a conical taper portion extending from an adapter muzzle end and a threaded portion extending along a portion of the muzzle device adapter, between the adapter muzzle end and an adapter barrel end; and an over barrel muzzle device having an externally threaded portion extending, from a muzzle device first and, along an exterior portion of the over barrel muzzle device.

In certain exemplary, nonlimiting embodiments of the present disclosure, the lock collar is movable between a retracted position and an extended position, relative to the gas block nut, wherein the lock collar is able to be threadedly attached to the gas block nut in the retracted position, and wherein the lock collar is able to be threadedly attached to the gas block nut in the extended position.

In certain exemplary, nonlimiting embodiments of the present disclosure, further comprising a substantially circumferential barrel projection extending around an outer circumference of the barrel body, extending from a barrel projection shoulder, wherein the barrel projection shoulder extends from a gas block attachment area of the barrel toward the barrel chamber end, and wherein a barrel projection notch is formed in a portion of the barrel projection.

In certain exemplary, nonlimiting embodiments of the present disclosure, an extension alignment protrusion extends from a gas block so as to be alignable with at least a portion of the barrel projection notch of the gas block.

In certain exemplary, nonlimiting embodiments of the present disclosure, further comprising a gas block having a gas block body portion and a gas block portion, wherein the gas block body portion extends from a gas block proximal end to a gas block distal end and includes a gas block barrel borehole extending therethrough, wherein a tapered proximal shoulder is formed in the gas block proximal end of the gas block barrel borehole, wherein the tapered proximal shoulder is mateable with the barrel conical shoulder to form an at least partial gas seal between the gas block and the barrel, wherein a tapered distal shoulder is formed in the gas block distal end of the gas block barrel borehole wherein the tapered distal shoulder is mateable with a compression ring tapered portion of a gas block compression ring to form an at least partial gas seal between the gas block and the gas block compression ring, wherein the gas block portion extends from the gas block body portion and includes a gas block gas port and a gas tube borehole, wherein an extension alignment protrusion extends from the gas block portion so as to be alignable with at least a portion of the barrel projection notch of the gas block, wherein a gas tube borehole extends from the gas block proximal end of the gas block extension portion and into at least a portion of the gas block extension portion, wherein a gas block gas port is disposed between the gas block barrel borehole and the gas tube borehole.

In certain exemplary, nonlimiting embodiments of the present disclosure, at least a portion of the gas block extension portion extends beyond at least a portion of the gas block portion and the gas block body portion.

In certain exemplary, nonlimiting embodiment, the over barrel muzzle device attachment system of the present disclosure includes at least some of an elongate barrel having a barrel body and extending, along a longitudinal axis, from a barrel chamber end to a barrel muzzle end, wherein a barrel borehole is formed through the barrel body, along the longitudinal axis, wherein the barrel includes a threaded muzzle device attachment area within a reduced diameter portion of the barrel body that extends from the barrel muzzle end of the barrel to a muzzle device shoulder, which extends between the reduced diameter portion of the barrel body and a subsequent portion of the barrel body, wherein the threaded muzzle device attachment area includes muzzle threads that extend, within the threaded muzzle device attachment area, from the barrel muzzle end of the barrel, toward the barrel chamber end of the barrel, an externally threaded gas block nut attachment area, comprising external gas block nut threads, is spaced apart from the muzzle device shoulder and extends toward the barrel chamber end, a gas block attachment area extending from the gas block nut attachment area toward the barrel chamber end, wherein the gas block attachment area has an outer diameter formed so as to allow at least a portion of a gas block barrel borehole of a gas block to be slidably positioned around at least a portion of the gas block attachment area, wherein a barrel gas port is formed within the gas block attachment area to provide fluid communication between the barrel borehole and an exterior surface of the barrel body, a substantially circumferential barrel projection extending around an outer circumference of the barrel body, extending from a barrel projection shoulder, wherein the barrel projection shoulder extends from the gas block attachment area toward the barrel chamber end, and wherein a barrel projection notch is formed in a portion of the barrel projection; a gas block having a gas block body portion and a gas block portion, wherein the gas block body portion extends from a gas block proximal end to a gas block distal end and includes a gas block barrel borehole extending therethrough, wherein a tapered proximal shoulder is formed in the gas block proximal end of the gas block barrel borehole, wherein the tapered proximal shoulder is mateable with the barrel conical shoulder to form an at least partial gas seal between the gas block and the barrel, wherein a tapered distal shoulder is formed in the gas block distal end of the gas block barrel borehole wherein the tapered distal shoulder is mateable with a compression ring tapered portion of a gas block compression ring to form an at least partial gas seal between the gas block and the gas block compression ring, wherein the gas block portion extends from the gas block body portion and includes a gas block gas port and a gas tube borehole, wherein an extension alignment protrusion extends from the gas block portion so as to be alignable with at least a portion of the barrel projection notch of the gas block, wherein a gas tube borehole extends from the gas block proximal end of the gas block extension portion and into at least a portion of the gas block extension portion, wherein a gas block gas port is disposed between the gas block barrel borehole and the gas tube borehole, such that the gas block barrel borehole is in fluid communication with the gas tube borehole, via the gas block gas port, and wherein the barrel gas port is alignable with the gas block gas port such that the barrel borehole, the barrel gas port, the gas block gas port, and the gas tube borehole may be in fluid communication; a gas block nut formed of a gas block nut body, extending from a first gas block nut end to a second gas block nut end and having a gas block nut aperture extending therethrough, wherein a first externally threaded portion extending from the second gas block nut end, a second externally threaded portion formed at a spaced apart location from the first externally threaded portion, and an internally threaded portion extending from the first gas block nut end, within at least a portion of the gas block nut aperture; a lock collar formed of a lock collar body, extending from a first lock collar end to a second lock collar end and having a lock collar aperture extending therethrough, wherein a first internally threaded portion extending from a second lock collar end into at least a portion of a lock collar aperture and a second internally threaded portion extending from a first lock collar end into at least a portion of the lock collar aperture, wherein the lock collar aperture has a first inner diameter within at least a portion of the first internally threaded portion and a second, smaller, inner diameter, within at least a portion of the second internally threaded portion, wherein an internal lock collar shoulder is formed within a portion of the lock collar aperture, between the first internally threaded portion and the second internally threaded portion; a gas block lock ring having an at least partially internally threaded gas block lock ring aperture formed within at least a portion of a gas block lock ring aperture; a muzzle device adapter having a conical taper portion extending from an adapter muzzle end and a threaded portion extending along a portion of the muzzle device adapter, between the adapter muzzle end and an adapter barrel end; and an over barrel muzzle device having an externally threaded portion extending, from a muzzle device first and, along an exterior portion of the over barrel muzzle device.

In certain exemplary, nonlimiting embodiments of the present disclosure, the barrel conical shoulder forms a transition surface between the gas block attachment area and a portion of the barrel projection shoulder.

In certain exemplary, nonlimiting embodiments of the present disclosure, the barrel conical shoulder has a surface portion formed at a 30° angle or a 150° angle relative to the barrel borehole of the barrel.

In certain exemplary, nonlimiting embodiments of the present disclosure, the barrel projection notch is formed in a top dead center or 12 o'clock alignment position of the barrel.

In certain exemplary, nonlimiting embodiments of the present disclosure, the barrel projection notch is formed such that interaction between at least a portion of the extension alignment protrusion and at least a portion of the barrel projection notch assists in maintaining the gas block in a desired rotational position relative to the barrel.

In certain exemplary, nonlimiting embodiments of the present disclosure, the barrel gas port is formed at a 25° angle, a 45° angle, a 65° angle, a 135° angle, a 115° angle, or a 155° angle relative to the longitudinal axis of the barrel borehole.

In certain exemplary, nonlimiting embodiments of the present disclosure, the barrel gas port is formed at an acute, 90°, or obtuse angle relative to the longitudinal axis of the barrel borehole.

In certain exemplary, nonlimiting embodiments of the present disclosure, the gas block compression ring comprises a gas block compression ring aperture formed therethrough and includes a compression ring tapered portion.

In certain exemplary, nonlimiting embodiments of the present disclosure, at least a portion of the gas block extension portion extends beyond at least a portion of the gas block portion and the gas block body portion.

In certain exemplary, nonlimiting embodiment, the barrel for an over barrel muzzle device attachment system of the present disclosure includes at least some of an elongate barrel having a barrel body and extending, along a longitudinal axis, from a barrel chamber end to a barrel muzzle end, wherein a barrel borehole is formed through the barrel body, along the longitudinal axis; a threaded muzzle device attachment area formed within a reduced diameter portion of the barrel body that extends from the barrel muzzle end of the barrel to a muzzle device shoulder, which extends between the reduced diameter portion of the barrel body and a subsequent portion of the barrel body, wherein the threaded muzzle device attachment area includes muzzle threads that extend, within the threaded muzzle device attachment area, from the barrel muzzle end of the barrel, to the muzzle device shoulder; an externally threaded gas block nut attachment area, comprising external gas block nut threads, is spaced apart from the muzzle device shoulder and extends toward the barrel chamber end; a gas block attachment area extending from the gas block nut attachment area toward the barrel chamber end, wherein the gas block attachment area has an outer diameter formed so as to allow at least a portion of a gas block barrel borehole of a gas block to be slidably positioned around at least a portion of the gas block attachment area, wherein a barrel gas port is formed within the gas block attachment area to provide fluid communication between the barrel borehole and an exterior surface of the barrel body; and a substantially circumferential barrel projection extending around an outer circumference of the barrel body, extending from a barrel projection shoulder, wherein the barrel projection shoulder extends from the gas block attachment area toward the barrel chamber end, and wherein a barrel projection notch is formed in a portion of the barrel projection.

In certain exemplary, nonlimiting embodiments of the present disclosure, the barrel projection notch is formed in a top dead center or 12 o'clock alignment position of the barrel.

In certain exemplary, nonlimiting embodiments of the present disclosure, the gas block attachment area has a diameter of approximately 0.075 inches or approximately 0.080 inches.

In certain exemplary, nonlimiting embodiments of the present disclosure, the barrel gas port is formed at a 25° angle, a 45° angle, a 65° angle, a 135° angle, a 115° angle, or a 155° angle relative to the longitudinal axis of the barrel borehole.

In certain exemplary, nonlimiting embodiments of the present disclosure, the barrel gas port is formed at an acute, 90°, or obtuse angle relative to the longitudinal axis of the barrel borehole.

Accordingly, the presently disclosed systems, methods, and/or apparatuses provide an over barrel muzzle device attachment system that allows for a mounting surface or muzzle device adapter that may be permanently attached to a barrel.

The presently disclosed systems, methods, and/or apparatuses optionally and separately provide a allows an over barrel muzzle device to be quickly and easily attached or removed from a barrel.

The presently disclosed systems, methods, and/or apparatuses optionally and separately provide an over barrel muzzle device attachment system that can be easily utilized by a user.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the systems, methods, and/or apparatuses that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF THE INVENTION

Figure 1:
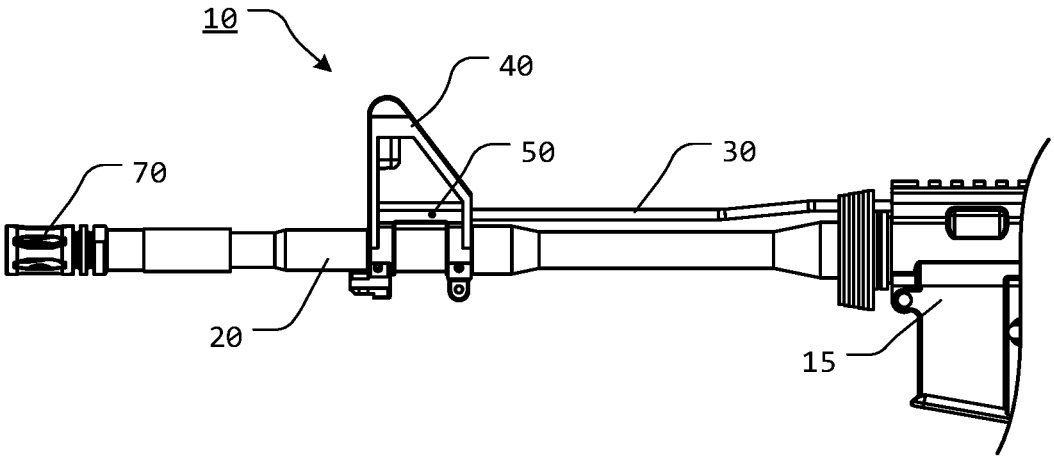
FIG. 1 PRIOR ART
FIG. 1 illustrates a side view of a portion of a known AR-15 style barrel assembly, showing a known front sight (or gas block)

For simplicity and clarification, the design factors and operating principles of the over barrel muzzle device attachment system and/or muzzle device system according to certain aspects of the presently disclosed systems, methods, and/or apparatuses are explained with reference to various exemplary embodiments of an over barrel muzzle device attachment system and/or muzzle device system according to certain aspects of the presently disclosed systems, methods, and/or apparatuses. The basic explanation of the design factors and operating principles of the over barrel muzzle device attachment system and/or muzzle device system is applicable for the understanding, design, and operation of the over barrel muzzle device attachment system and/or muzzle device system of the presently disclosed systems, methods, and/or apparatuses. It should be appreciated that the over barrel muzzle device attachment system and/or muzzle device system can be adapted to many applications where excessive gas pressure or blowback is experienced within a firearm.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "AR-15", "firearm", and "gas block" are used for basic explanation and understanding of the operation of the systems, methods, and apparatuses of the present disclosure. Therefore, the terms "AR-15", "firearm", and "gas block" are not to be construed as limiting the systems, methods, and apparatuses of the present disclosure. Thus, the terms "AR-15" and "firearm" are to be understood to broadly include any firearm having a blowback operated system.

For simplicity and clarification, the compression screw attachment system of the present disclosure will be described as being used in connection with a safety selector lever for an AR-15 or M4 style firearm. However, it should be appreciated that these are merely exemplary embodiments of the compression screw attachment system and are not to be construed as limiting the present disclosure. Thus, the compression screw attachment system of the present disclosure may be utilized in connection with any firearm or other device and may be utilized to attach or couple elements together.

Figure 2:
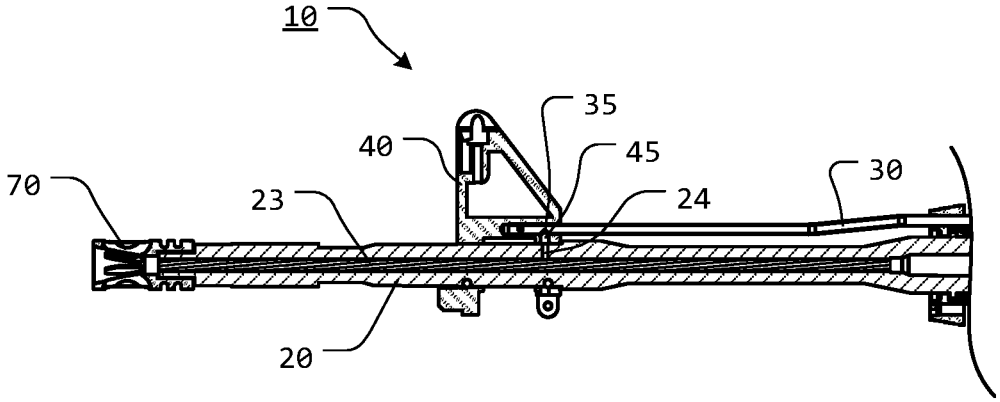
FIG. 2 PRIOR ART
FIG. 2 illustrates a side cutaway view of a portion of a known AR-15 style barrel assembly, showing a known front sight (or gas block)

In the form of the present disclosure chosen for purposes of illustration, FIGS. 1 and 2 illustrate certain elements and/or aspects of a known, exemplary AR-15 style barrel assembly 10, showing a known front sight gas block 40.

Generally, the barrel assembly 10 includes a barrel 20 extending from an upper receiver 15. The barrel 20 includes a borehole 23 and a barrel gas port 24. A front sight gas block 40 is fitted to the barrel 20 such that a front sight gas port 45 is aligned with the barrel gas port 24 and a gas tube gas port 35, such that the borehole 23 is in fluid communication (via barrel gas port 24, front sight gas port 45, and gas tube gas port 35) with the gas tube 30. The gas tube 30 is maintained in place relative to the front sight gas port 45, via a roll pin 50. In this manner, the barrel assembly 10 is able to operate, as described above.

A muzzle device 70, such as a flash suppressor or muzzle brake is typically threadedly attached directly to the muzzle end of the barrel 20 by direct interaction between internal threads of the muzzle device and external threads of the barrel 20.

It should be appreciated that a more detailed explanation of the components of the barrel assembly 10, instructions regarding how to attach and use the various components of the barrel assembly 10, methods for installing the related components of the barrel assembly 10, and certain other items and/or techniques necessary for the implementation and/or operation of the various components of the AR-15 platform are not provided herein because such components are commercially available and/or such background information will be known to one of ordinary skill in the art. Therefore, it is believed that the level of description provided herein is sufficient to enable one of ordinary skill in the art to understand and practice the systems, methods, and/or apparatuses as described.

FIGS. 3-35 illustrate certain elements and/or aspects of various exemplary embodiments of a gas block 130, according to this invention. In certain illustrative, non-limiting embodiments of the present disclosure, as illustrated in FIGS. 3-35, the gas block 130 comprises at least some of a barrel 110, a gas block 130, a lock collar 160, and muzzle device adapter 180.

Figure 3:
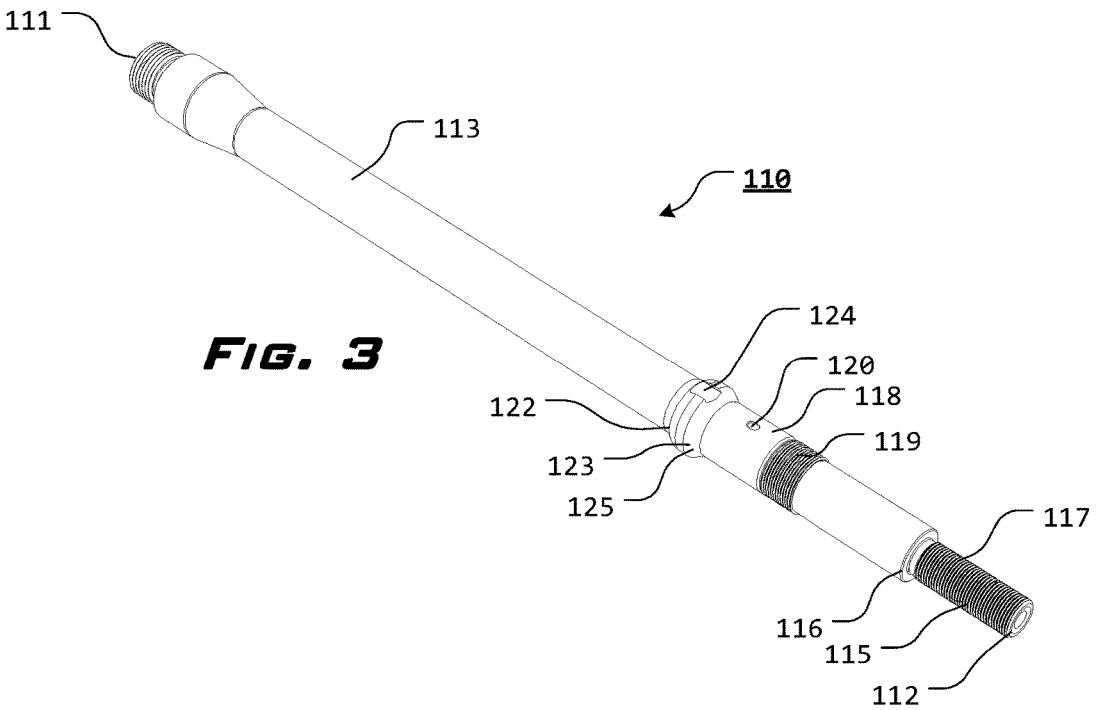
FIG. 3 illustrates an upper, front, perspective view of an exemplary embodiment of a barrel, according to certain aspects of the presently disclosed systems, methods, and/or apparatuses.
Figure 4:
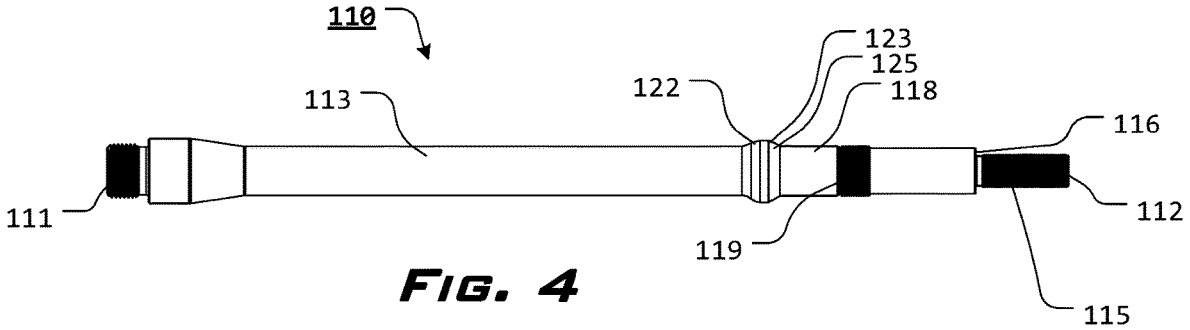
FIG. 4 illustrates a left side view of an exemplary embodiment of a barrel, according to certain aspects of the presently disclosed systems, methods, and/or apparatuses.
Figure 5:
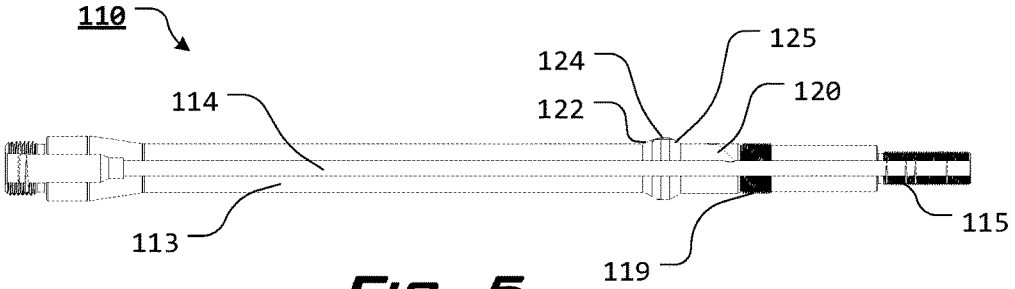
FIG. 5 illustrates a left side, cross-sectional view of an exemplary embodiment of a barrel, according to certain aspects of the presently disclosed systems, methods, and/or apparatuses.

As illustrated most clearly in FIGS. 3-5, the barrel 110 comprises an elongate barrel 110 having a barrel body 113 and extending, along a longitudinal axis, $A_L$, from a barrel chamber end 111 to a barrel muzzle end 112. A barrel borehole 114 is formed through the barrel body 113, along the longitudinal axis. It should be appreciated that the barrel 110 may be a rifle barrel, a pistol barrel, or any other small or large caliber operable, toy, or replica firearm, artillery, or other barrel.

The barrel 110 includes a threaded muzzle device attachment area 115 having muzzle threads that extend, within a threaded muzzle device attachment area 115, from the barrel muzzle end 112 of the barrel 110, toward the barrel chamber end 111 of the barrel 110. In various exemplary embodiments, the muzzle threads within the threaded muzzle device attachment area 115 are similar to known muzzle threads included on a standard barrel. However, the threaded muzzle device attachment area 115 may extend further along the barrel muzzle end 112 of barrel 110 than known muzzle threads on a standard barrel.

In certain exemplary embodiments, the muzzle threads within the threaded muzzle device attachment area 115 extend within a reduced diameter portion 117 of the barrel body 113. The reduced diameter portion 117 of the barrel body 113 extends to a muzzle device shoulder 116. The muzzle device shoulder 116 extends between a reduced diameter portion 117 of the barrel body 113 and a subsequent portion of the barrel body 113.

It should be appreciated that in certain exemplary embodiments, the barrel muzzle end portion of the barrel 110 is formed substantially similarly to a known barrel muzzle end portion of a firearm barrel. Thus, the threaded muzzle device attachment area 115, the reduced diameter portion 117, and the muzzle device shoulder 116 are optional elements and may or may not be included.

An externally threaded gas block nut attachment area 119, comprising external gas block nut threads, is formed so as to extend between at least a portion of the barrel body 113, between the muzzle device shoulder 116 and the barrel projection 122. The gas block attachment area 118 is formed between the gas block nut attachment area 119 and the barrel projection 122. The gas block attachment area 118 has an outer diameter formed so as to allow at least a portion of the gas block attachment area 118 to be slidably positioned within the gas block barrel borehole 139 of the gas block 130.

In various exemplary embodiments, the gas block attachment area 118 has a diameter of approximately 0.075 inches. Alternatively, the gas block attachment area 118 may have a diameter of approximately 0.080 inches. It should be appreciated that the gas block attachment area 118 may have any desired diameter.

A barrel gas port 120 is formed within the gas block attachment area 118. The barrel gas port 120 extends between the barrel borehole 114 and an exterior surface of the barrel body 113. In various exemplary embodiments, the barrel gas port 120 is formed at a 45° angle (or 135° angle) relative to the longitudinal axis of the barrel borehole 114. In various alternative embodiments, the barrel gas port 120 is formed at an angle between 25° and 65° (or 115° and 155°) relative to the longitudinal axis of the barrel borehole 114. In still other exemplary embodiments, the barrel gas port 120 is formed at any acute, 90°, or obtuse angle relative to the longitudinal axis of the barrel borehole 114. By providing the barrel gas port 120 at such an angle, the gas port erosion caused by blast gases passing from the barrel borehole 114 through the barrel gas port 120 is reduced. This angled positioning of the barrel gas port 120 also allows the barrel gas port 120 to be positioned further forward along the barrel 110 in relation to the gas block attachment area 118.

A barrel projection 122 is formed around the barrel body 113. The barrel projection 122 extends from a barrel projection shoulder 123 to provide an abutment surface for the gas block proximal end 131 of the gas block 130. In various exemplary embodiments, the barrel projection 122 extends around an outer circumference of the barrel body 113. The barrel conical shoulder 125 forms a transition surface between the gas block attachment area 118 and a portion of the barrel projection shoulder 123. In various exemplary embodiments, the barrel conical shoulder 125 has a surface portion formed at a 30° angle (or 150° angle) relative to the barrel borehole 114 of the barrel 110. It should be appreciated that the barrel conical shoulder 125 may have a surface portion formed at another desired angle (such as an acute or obtuse angle), relative to the barrel borehole 114 of the barrel 110.

In certain exemplary embodiments, a barrel projection notch 124 is formed in a portion of the barrel projection 122. The barrel projection notch 124, if included, is formed in a portion of the barrel projection 122, representing a top dead center or 12 o'clock alignment position of the barrel 110. In certain alternative embodiments, the barrel projection notch 124, if included, may be formed at a different desired location around the barrel projection 122. If included, the barrel projection notch 124 is formed so as to interact with at least a portion of an extension alignment protrusion 136 of the gas block 130. When the gas block 130 is installed on the barrel 110, alignment of at least a portion of the extension alignment protrusion 136 within at least a portion of the barrel projection notch 124 helps to maintain the gas block 130 in a desired rotational position relative to the barrel 110.

Figure 6:
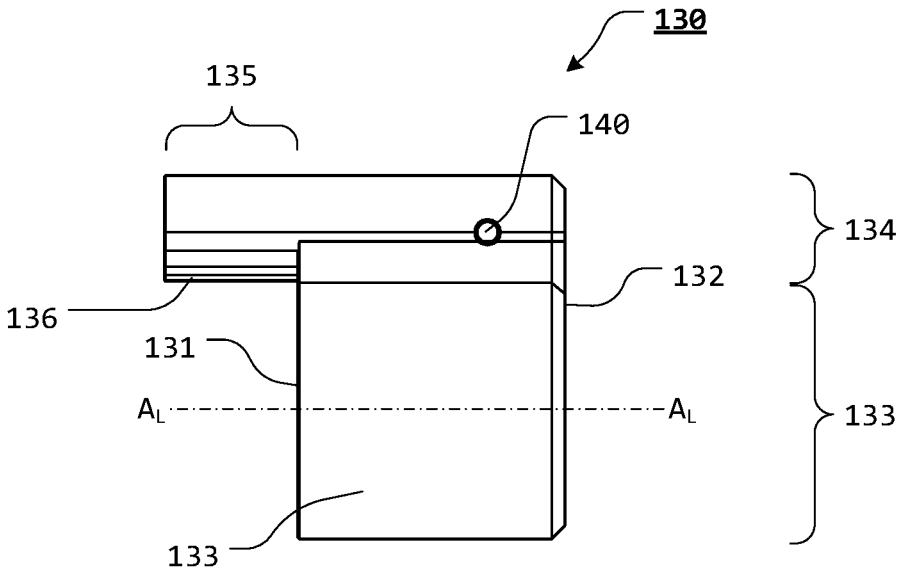
FIG. 6 illustrates a right side view of an exemplary embodiment of a gas block, according to certain aspects of the presently disclosed systems, methods, and/or apparatuses.
Figure 7:
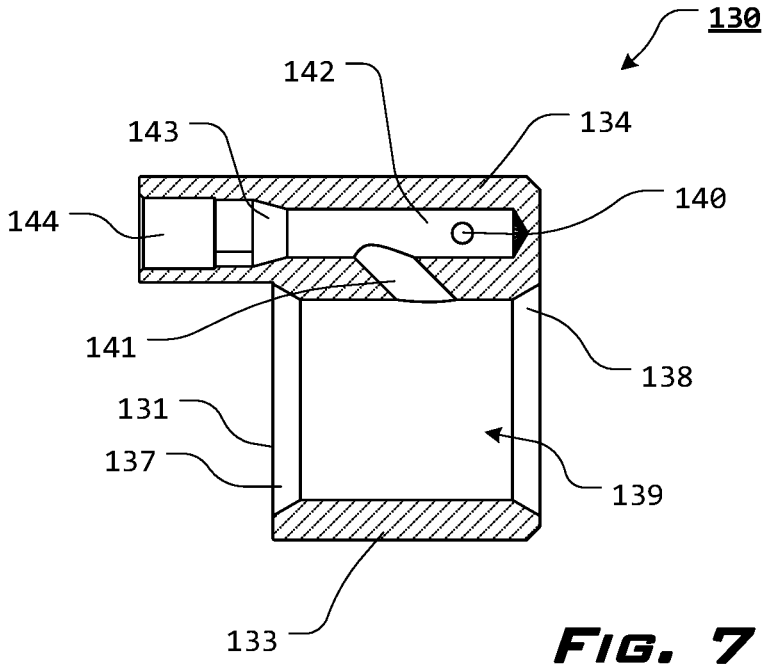
FIG. 7 illustrates a right side, cross-sectional view of an exemplary embodiment of a gas block, according to certain aspects of the presently disclosed systems, methods, and/or apparatuses.
Figure 8:
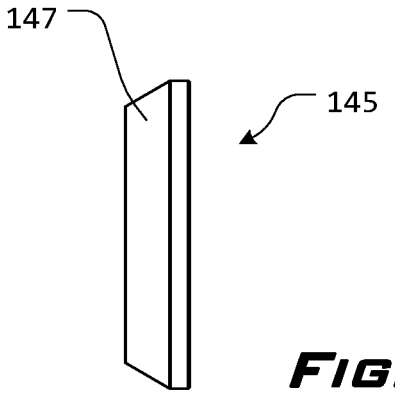
FIG. 8 illustrates a right side view of an exemplary embodiment of a gas block compression ring, according to certain aspects of the presently disclosed systems, methods, and/or apparatuses.
Figure 9:
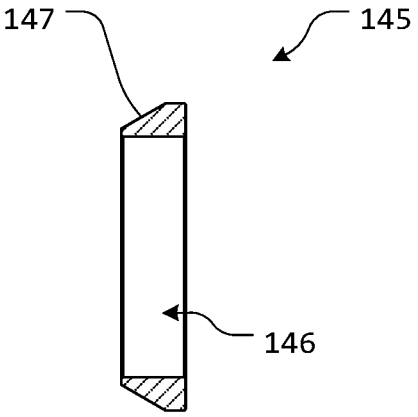
FIG. 9 illustrates a right side, cross-sectional view of an exemplary embodiment of a gas block compression ring, according to certain aspects of the presently disclosed systems, methods, and/or apparatuses.
Figure 10:
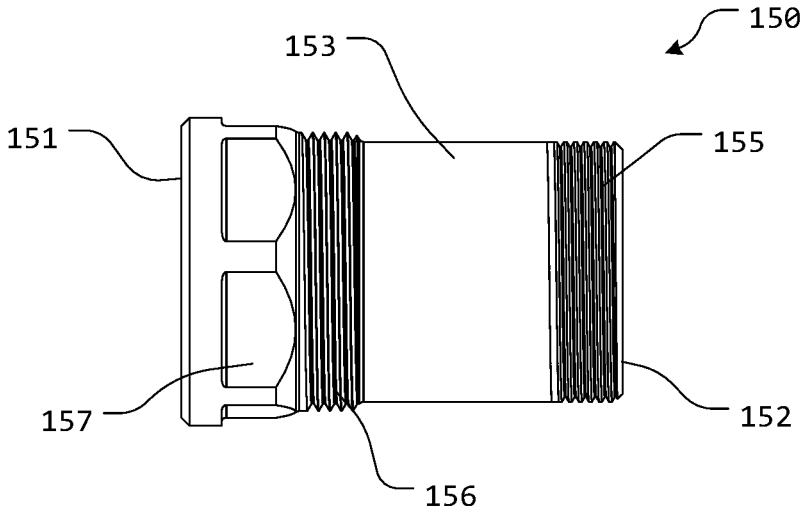
FIG. 10 illustrates a right side view of an exemplary embodiment of a gas block nut, according to certain aspects of the presently disclosed systems, methods, and/or apparatuses.
Figure 11:
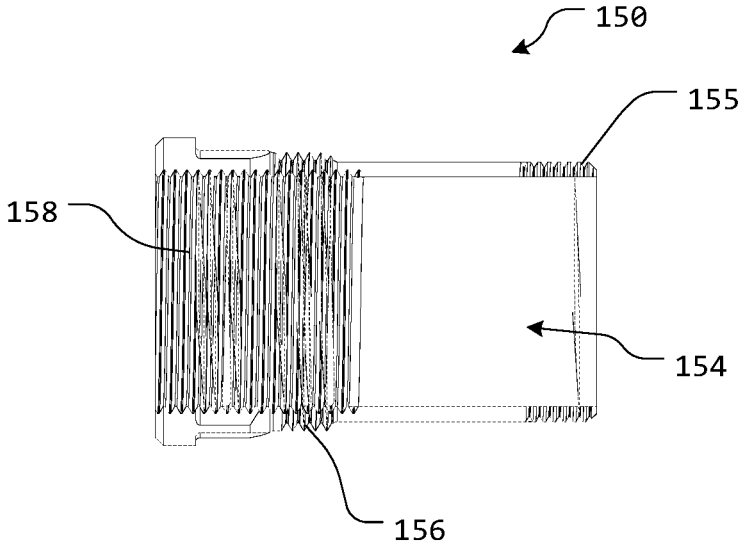
FIG. 11 illustrates a right side, cross-sectional view of an exemplary embodiment of a gas block nut, according to certain aspects of the presently disclosed systems, methods, and/or apparatuses.
Figure 12:
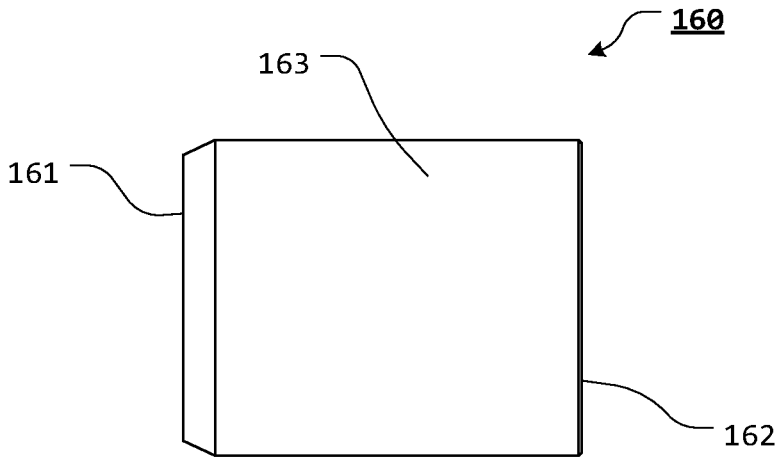
FIG. 12 illustrates a right side view of an exemplary embodiment of a lock collar, according to certain aspects of the presently disclosed systems, methods, and/or apparatuses.
Figure 13:
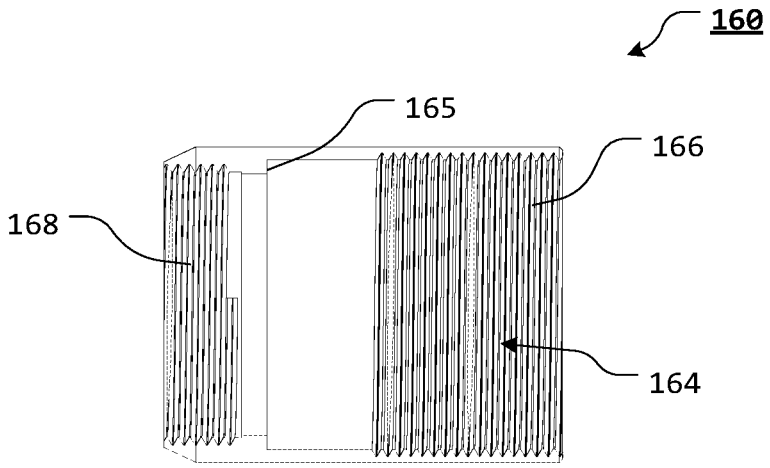
FIG. 13 illustrates a right side, cross-sectional view of an exemplary embodiment of a lock collar, according to certain aspects of the presently disclosed systems, methods, and/or apparatuses.
Figure 14:
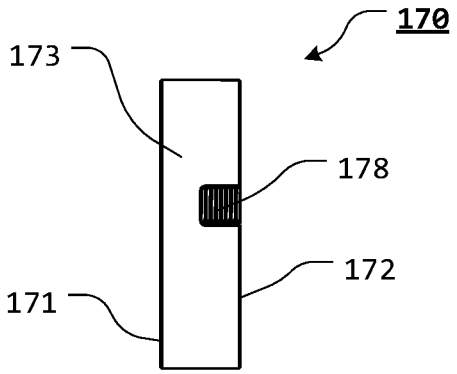
FIG. 14 illustrates a right side view of an exemplary embodiment of a gas block lock ring, according to certain aspects of the presently disclosed systems, methods, and/or apparatuses.
Figure 15:
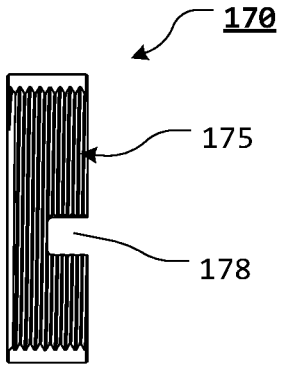
FIG. 15 illustrates a right side, cross-sectional view of an exemplary embodiment of a gas block lock ring, according to certain aspects of the presently disclosed systems, methods, and/or apparatuses.
Figure 16:
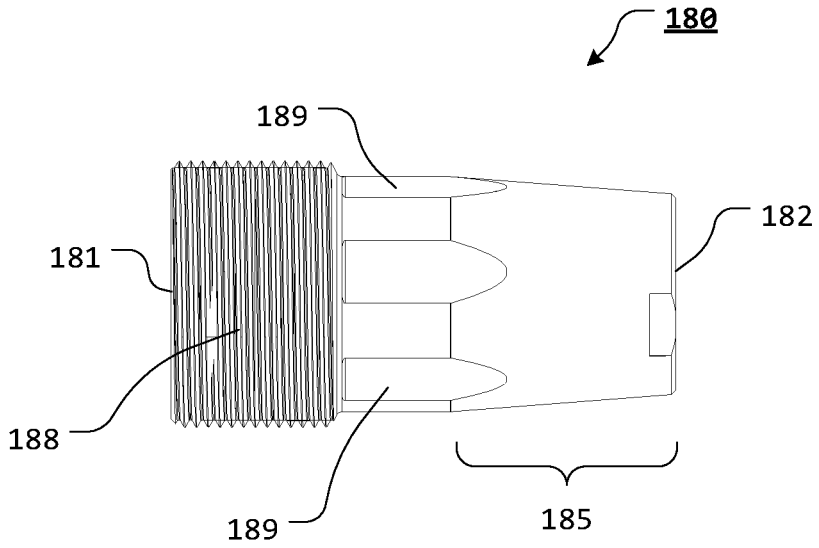
FIG. 16 illustrates a right side view of an exemplary embodiment of a muzzle device adapter, according to certain aspects of the presently disclosed systems, methods, and/or apparatuses.

As illustrated most clearly in FIGS. 6-7, the gas block 130 extends, substantially parallel to a longitudinal axis $A_L$, from a gas block proximal end 131 to a gas block distal end 132 and includes a gas block body portion 133 and a gas block portion 134. A gas block barrel borehole 139 extends through the gas block body portion 133, along the longitudinal axis $A_L$. The gas block barrel borehole 139 is adapted to receive at least a portion of the barrel 110 therethrough. In various exemplary embodiments, the gas block barrel borehole 139 is adapted to receive a portion of the gas block attachment area 118 of the barrel 110 therethrough.

A tapered proximal shoulder 137 is formed in the gas block proximal end 131 of the gas block barrel borehole 139. The size, shape, and angle of the tapered proximal shoulder 137 corresponds to the size, shape, and angle of the barrel conical shoulder 125. Thus, as the gas block proximal end 131 of the gas block body portion 133 is urged toward the barrel projection shoulder 123, the barrel conical shoulder 125 interacts with the tapered proximal shoulder 137 to form a gas seal between the gas block 130 and the barrel 110.

A tapered distal shoulder 138 is formed in the gas block distal end 132 of the gas block barrel borehole 139. The size, shape, and angle of the tapered distal shoulder 138 corresponds to the size, shape, and angle of the compression ring tapered portion 147 of the gas block compression ring 145. Thus, as the gas block distal end 132 of the gas block body portion 133 is contacted by the compression ring tapered portion 147 of the gas block compression ring 145 and the gas block compression ring 145 is urged toward the barrel projection shoulder 123, the compression ring tapered portion 147 interacts with the tapered distal shoulder 138 to form a gas seal between the gas block 130 and the gas block compression ring 145.

In various exemplary, nonlimiting embodiments, the gas block compression ring 145 comprises a gas block compression ring aperture 146 formed therethrough and includes a compression ring tapered portion 147.

The tapered proximal shoulder 137 and the tapered distal shoulder 138 may optionally comprise a 30° angled surface. In certain embodiments, the tapered proximal shoulder 137 and the tapered distal shoulder 138 comprise angled surfaces having a 20°-40° angle. However, it should be appreciated that the angled surfaces of the tapered proximal shoulder 137 and the tapered distal shoulder 138 to be any desired angle. Furthermore, the angle of the tapered proximal shoulder 137 and the tapered distal shoulder 138 may be the same or different angles.

The gas block portion 134 extends from the gas block body portion 133 and includes a gas block gas port 141 and a gas tube borehole 142. A gas block extension portion 135 extends from the gas block portion 134. In various exemplary embodiments, an extension alignment protrusion 136 extends from at least a portion of the gas block extension portion 135 of the gas block 130. When the gas block 130 is installed on the barrel 110, interaction of the barrel projection notch 124 and the extension alignment protrusion 136 helps to maintain the gas block 130 in a desired rotational position relative to the barrel 110.

In various exemplary, nonlimiting embodiments, at least a portion of the gas block extension portion 135 extends beyond at least a portion of the gas block portion 134 and the gas block body portion 133.

A gas tube borehole 142 extends from the gas block proximal end 131 of the gas block extension portion 135 and into at least a portion of the gas block extension portion 135. In various exemplary embodiments, the gas tube borehole 142 extends along the longitudinal axis $A_L$ of the gas block extension portion 135, parallel to the gas block barrel borehole 139.

The gas tube borehole 142 includes an initial portion 144 and a tapered borehole portion 143. The gas tube borehole 142 is formed so as to receive an end portion of a gas tube, such as, for example, a portion of the gas tube 30, therein.

In various exemplary embodiments, the gas tube may optionally be secured within the gas tube borehole 142 by the interaction of a role pin positioned through aligned roll pin apertures 140 of the gas block 130 and the gas tube.

A gas block gas port 141 is disposed between the gas block barrel borehole 139 and the gas tube borehole 142, such that the gas block barrel borehole 139 is in fluid communication with the gas tube borehole 142, via the gas block gas port 141. The gas block gas port 141 is formed such that, when the gas block 130 is properly secured to a barrel 110 and a gas tube is properly secured within the gas tube borehole 142, the barrel gas port 120 is aligned with and in fluid communication with the gas block gas port 141 such that the barrel borehole 114 is in fluid communication (via the barrel gas port 120, the gas block gas port 141, and the gas tube borehole 142) with the gas tube.

In various exemplary embodiments, various components of the gas block 130 are substantially rigid and are formed of steel. Alternate materials of construction of the various components of the gas block 130 may include one or more of the following: titanium, aluminum, stainless steel, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the gas block 130 is a design choice based on the desired appearance and functionality of the gas block 130.

It should be appreciated that certain elements of the gas block 130 may be formed as an integral unit (such as, for example, the gas block body portion 133, the gas block portion 134, and/or the gas block extension portion 135). Alternatively, suitable materials can be used and sections or elements made independently and attached or coupled together, such as by adhesives, welding, screws, rivets, pins, or other fasteners, to form the various elements of the gas block 130.

It should also be understood that the overall size and shape of the gas block 130 and the various portions thereof is a design choice based upon the desired functionality and/or appearance of the gas block 130.

The gas block nut 150 is formed of a gas block nut body 153, extending from a first gas block nut end 151 to a second gas block nut end 152 and having a gas block nut aperture 154 formed therethrough. In various exemplary embodiments, a first externally threaded portion 155 extends from the second gas block nut end 152. A second externally threaded portion 156 is formed at a spaced apart location, along the gas block nut body 153, from the first externally threaded portion 155. An internally threaded portion 158 extends from the first gas block nut end 151, through at least a portion of the gas block nut aperture 154.

The threads of the first externally threaded portion 155 are formed so as to interact with the internal threads of the gas block lock ring 170. The external threads of the second externally threaded portion 156 are formed so as to optionally interact with internal threads of the second internally threaded portion 168 of the lock collar 160, when the lock collar 160 is in the retracted position. The threads of the internally threaded portion 158 are formed so as to interact with the external threads of the gas block nut attachment area 119.

To aid in the installation of the gas block nut 150, one or more gas block nut flats 157, formed of opposing parallel surfaces, may optionally be provided in various locations around the gas block nut body 153. The gas block nut flats 157, if included, provide parallel surfaces for a wrench or other installation device to grip the gas block nut 150.

The lock collar 160 is formed of a lock collar body 163, extending from a first lock collar end 161 to a second lock collar end 162, and having a lock collar aperture 164 extending therethrough.

In various exemplary embodiments, a first internally threaded portion 166 extends from the second lock collar end 162 into at least a portion of the lock collar aperture 164. A second internally threaded portion 168 extends from the first lock collar end 161 into at least a portion of the lock collar aperture 164. In various exemplary embodiments, the internal threads of the first internally threaded portion 166 are formed so as to interact with the external threads of the over barrel muzzle device 190. The internal threads of the second internally threaded portion 168 are formed so as to optionally interact with the external threads of the second externally threaded portion 156 of the gas block nut 150.

The lock collar aperture 164 has a first inner diameter within at least a portion of the first internally threaded portion 166 and a second, smaller, inner diameter, within at least a portion of the second internally threaded portion 168. An internal lock collar shoulder 165 is formed within a portion of the lock collar aperture 164, between the first internally threaded portion 166 and the second internally threaded portion 168.

The gas block lock ring 170 includes a gas block lock ring body portion 173 that extends, substantially parallel to a longitudinal axis $A_L$, from a gas block lock ring proximal end 171 to a gas block lock ring distal end 172. An at least partially internally threaded gas block lock ring aperture 175 is formed within at least a portion of the gas block lock ring body portion 173, extending along the longitudinal axis $A_L$. The at least partially internally threaded gas block lock ring aperture 175 is adapted to interact with the external threads of the first externally threaded portion 155 of the gas block nut 150.

One or more securing notches 178 may optionally be formed in the gas block lock ring distal end 172 of the gas block lock ring 170.

While the gas block lock ring 170 is illustrated as having a substantially cylindrical shape, much like a castle nut, it should be appreciated that the gas block lock ring 170 may comprise any alternative shapes, such as, for example, a hex nut.

The muzzle device adapter 180 extends from an adapter muzzle end 182 to an adapter barrel end 181.

In various exemplary embodiments, a conical taper portion 185 extends from the adapter muzzle end 182 of the muzzle device adapter 180, toward the adapter barrel end 181 of the muzzle device adapter 180. The outer diameter of the muzzle device adapter 180 body generally expands, along the conical taper portion 185, as the conical taper portion 185 extends toward the adapter barrel end 181 of the muzzle device adapter 180.

The muzzle device adapter 180 includes a threaded portion having adapter threads 188 that extend along a portion of the muzzle device adapter 180, between the adapter muzzle end 182 and the adapter barrel end 181. In various exemplary embodiments, the external adapter threads 188 are formed so as to optionally interact with internal threads of a subsequent muzzle device.

To aid in the installation of the muzzle device adapter 180, adapter flats 189 formed of opposing parallel surfaces may be provided in various locations around the muzzle device adapter 180. The adapter flats 189, if included, provide parallel surfaces for a wrench or other installation device to grip the muzzle device adapter 180.

Figure 17:
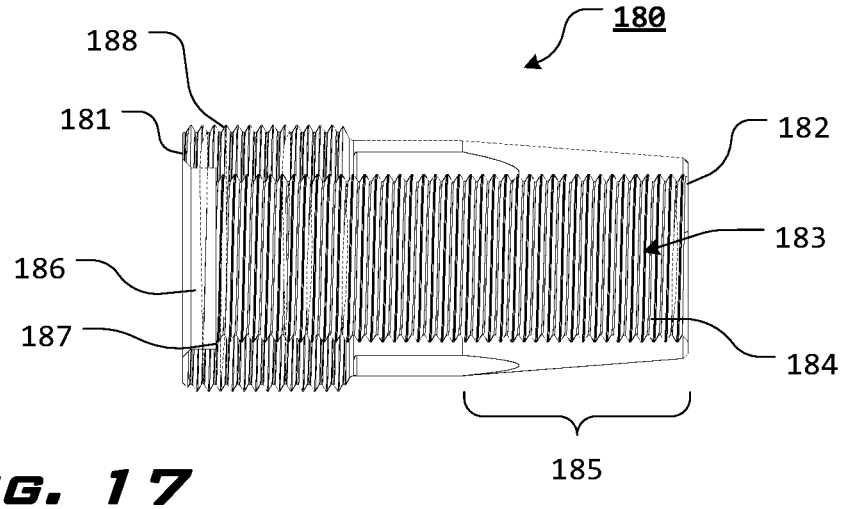
FIG. 17 illustrates a right side, cross-sectional view of an exemplary embodiment of a muzzle device adapter, according to certain aspects of the presently disclosed systems, methods, and/or apparatuses.
Figure 18:
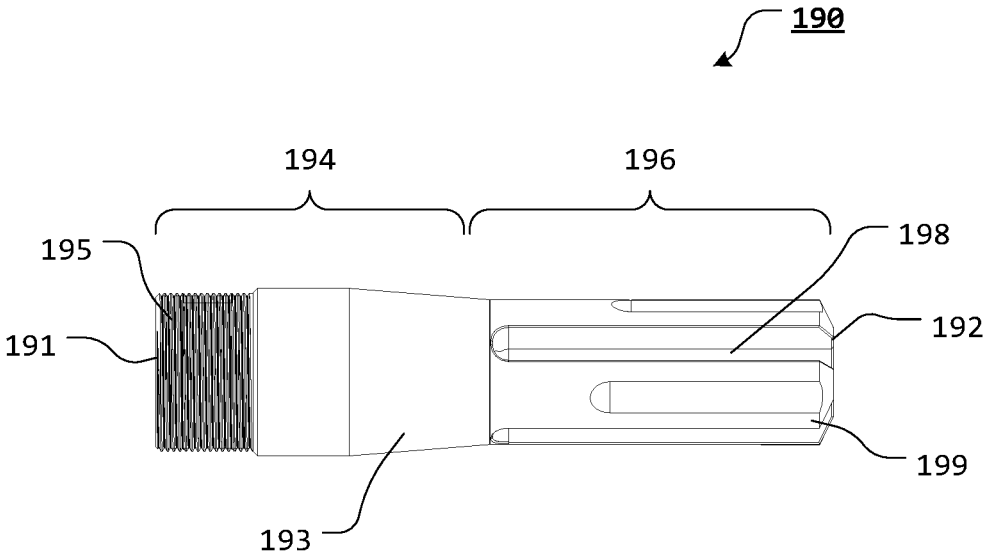
FIG. 18 illustrates a right side view of an exemplary embodiment of an over barrel muzzle device, according to certain aspects of the presently disclosed systems, methods, and/or apparatuses.
Figure 19:
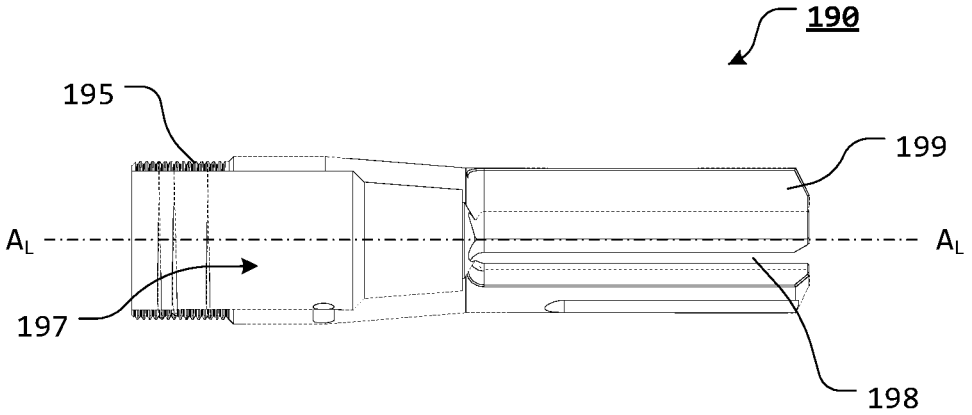
FIG. 19 illustrates a right side, cross-sectional view of an exemplary embodiment of an over barrel muzzle device, according to certain aspects of the presently disclosed systems, methods, and/or apparatuses.
Figure 20:
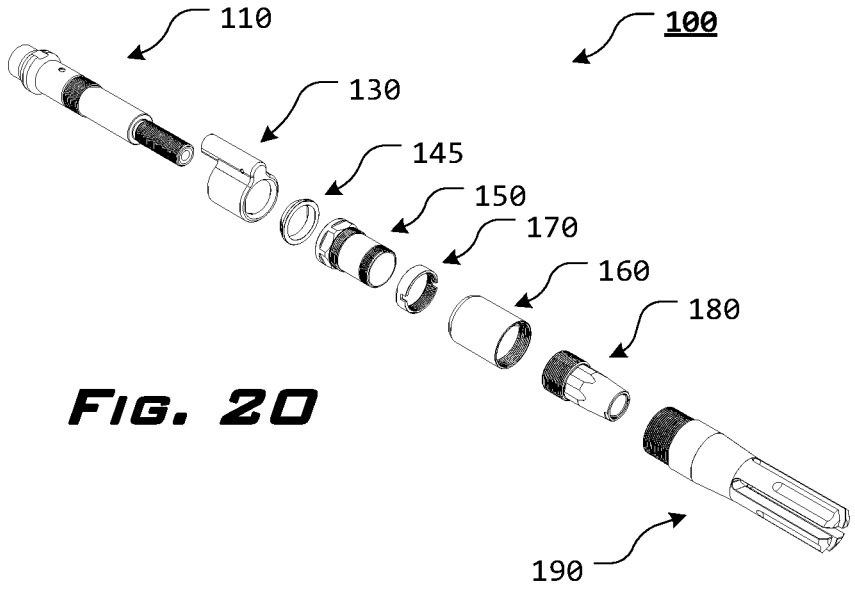
FIG. 20 illustrates an upper, front, exploded, perspective view of various exemplary components of the over barrel muzzle device attachment system, according to certain aspects of the presently disclosed systems, methods, and/or apparatuses.
Figure 21:
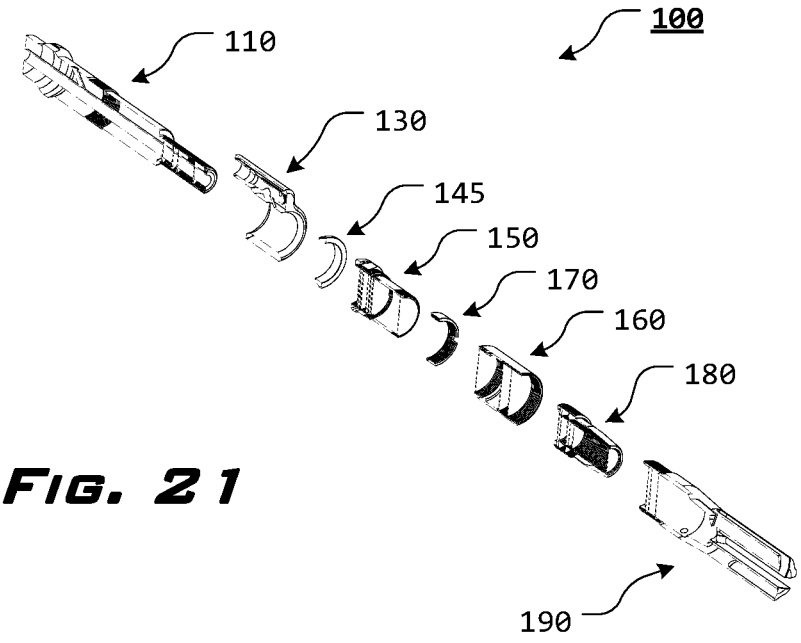
FIG. 21 illustrates an upper, front, exploded, perspective, cross-sectional view of various exemplary components of the over barrel muzzle device attachment system, according to certain aspects of the presently disclosed systems, methods, and/or apparatuses.
Figure 22:
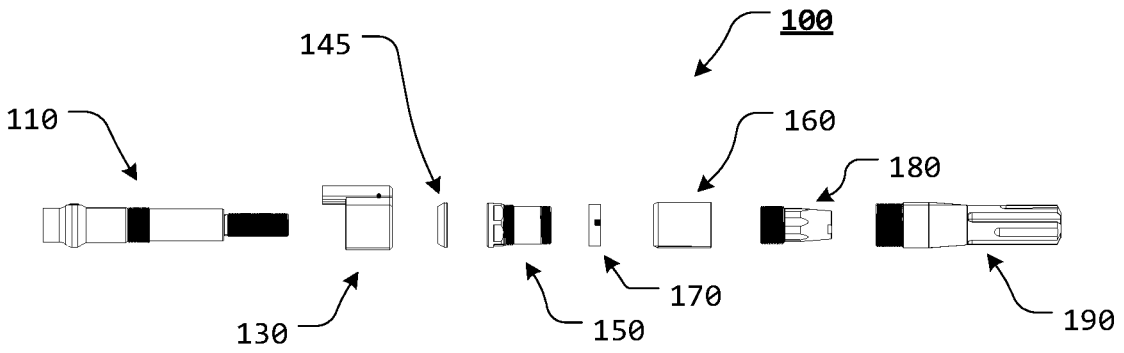
FIG. 22 illustrates a right, side, exploded view of various exemplary components of the over barrel muzzle device attachment system, according to certain aspects of the presently disclosed systems, methods, and/or apparatuses.
Figure 23:
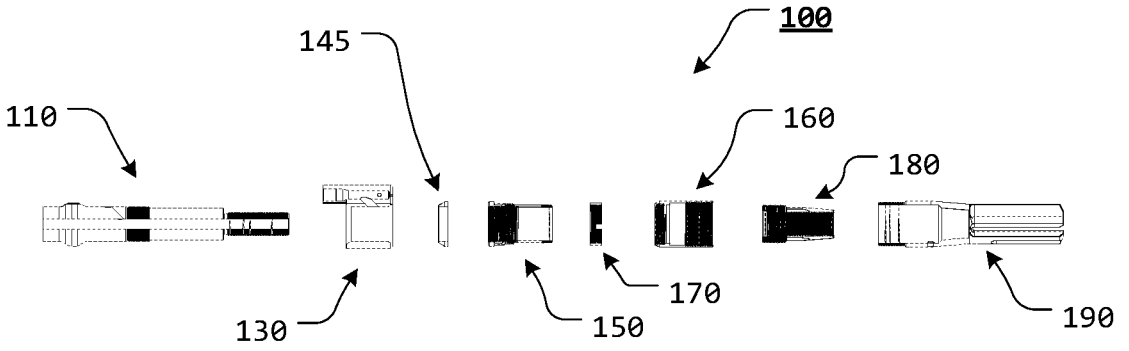
FIG. 23 illustrates a right, side, exploded, cross-sectional view of various exemplary components of the over barrel muzzle device attachment system, according to certain aspects of the presently disclosed systems, methods, and/or apparatuses.
Figure 24:
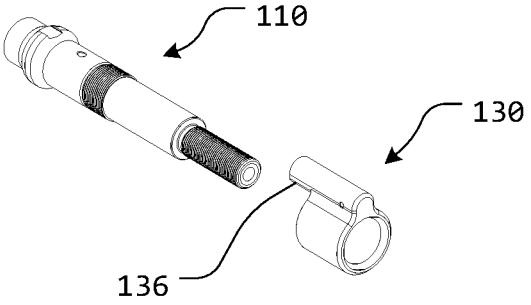
FIG. 24 illustrates an upper, front, perspective view of various exemplary components of the over barrel muzzle device attachment system being assembled according to certain aspects of the presently disclosed systems, methods, and/or apparatuses.
Figure 25:
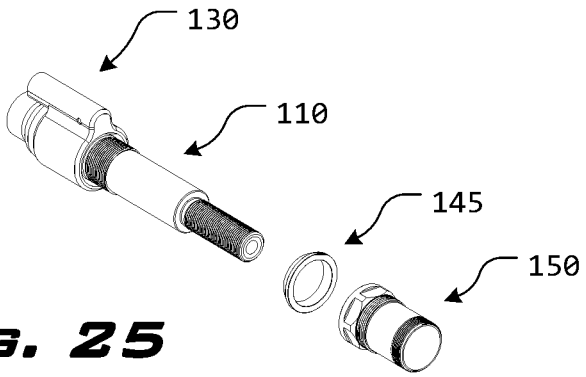
FIG. 25 illustrates an upper, front, perspective view of various exemplary components of the over barrel muzzle device attachment system being assembled according to certain aspects of the presently disclosed systems, methods, and/or apparatuses.
Figure 26:
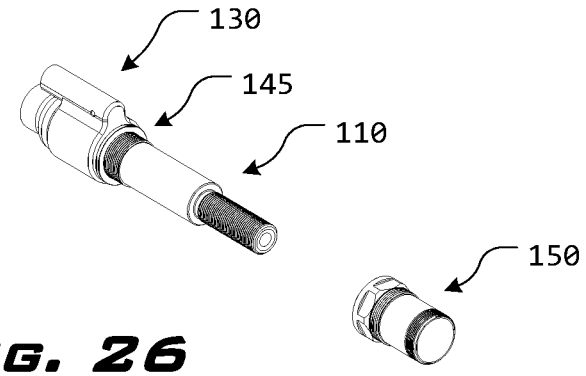
FIG. 26 illustrates an upper, front, perspective view of various exemplary components of the over barrel muzzle device attachment system being assembled according to certain aspects of the presently disclosed systems, methods, and/or apparatuses.
Figure 27:
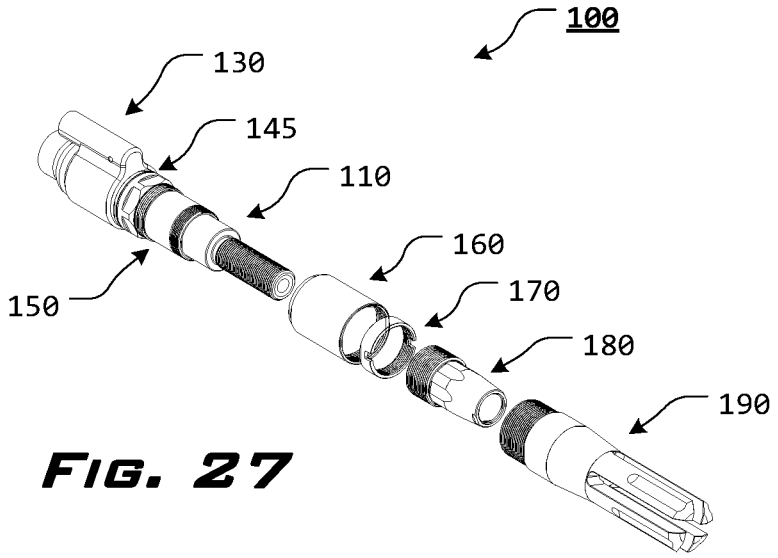
FIG. 27 illustrates an upper, front, perspective view of various exemplary components of the over barrel muzzle device attachment system being assembled according to certain aspects of the presently disclosed systems, methods, and/or apparatuses.
Figure 28:
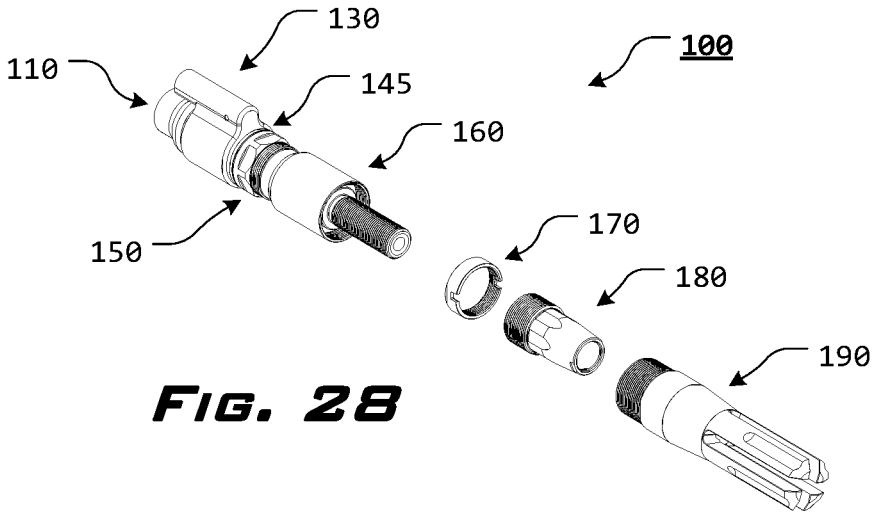
FIG. 28 illustrates an upper, front, perspective view of various exemplary components of the over barrel muzzle device attachment system being assembled according to certain aspects of the presently disclosed systems, methods, and/or apparatuses.
Figure 29:
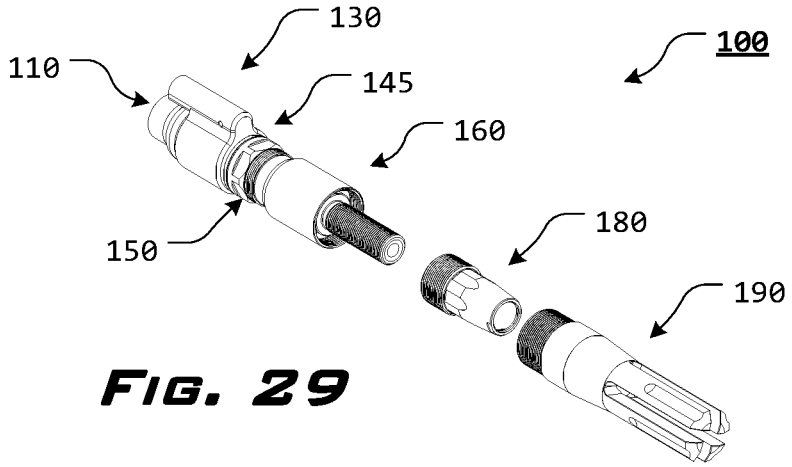
FIG. 29 illustrates an upper, front, perspective view of various exemplary components of the over barrel muzzle device attachment system being assembled according to certain aspects of the presently disclosed systems, methods, and/or apparatuses.
Figure 30:
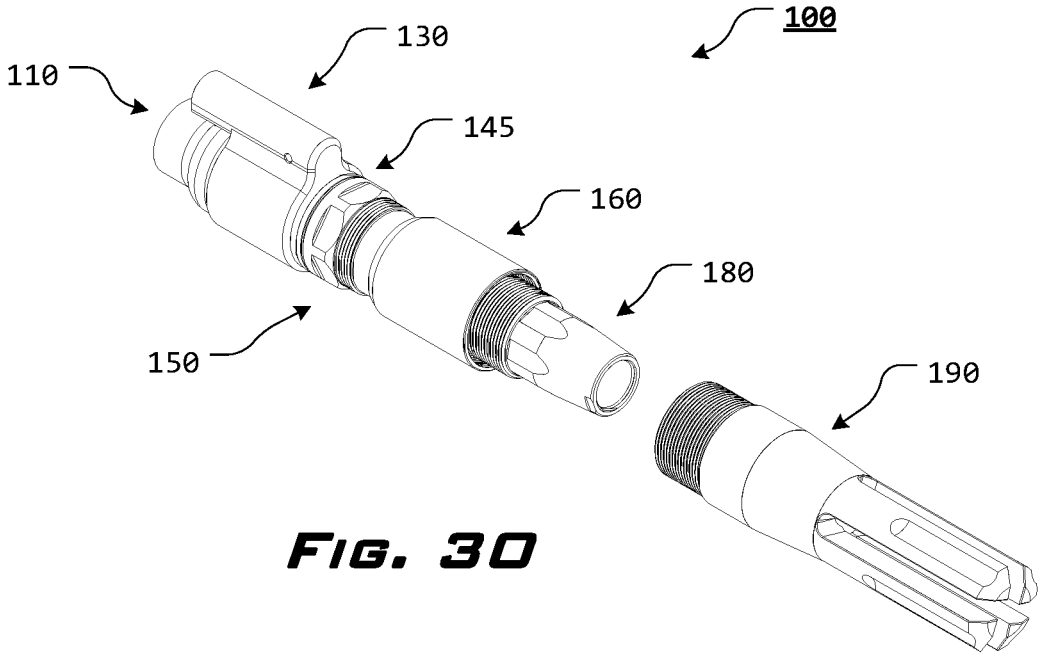
FIG. 30 illustrates an upper, front, perspective view of various exemplary components of the over barrel muzzle device attachment system being assembled according to certain aspects of the presently disclosed systems, methods, and/or apparatuses.
Figure 31:
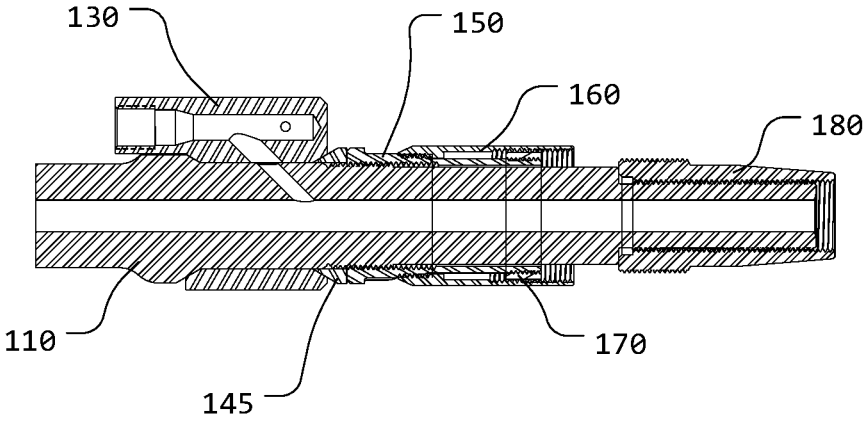
FIG. 31 illustrates right, side, cross-sectional view of various exemplary components of the over barrel muzzle device attachment system being assembled according to certain aspects of the presently disclosed systems, methods, and/or apparatuses.
Figure 32:
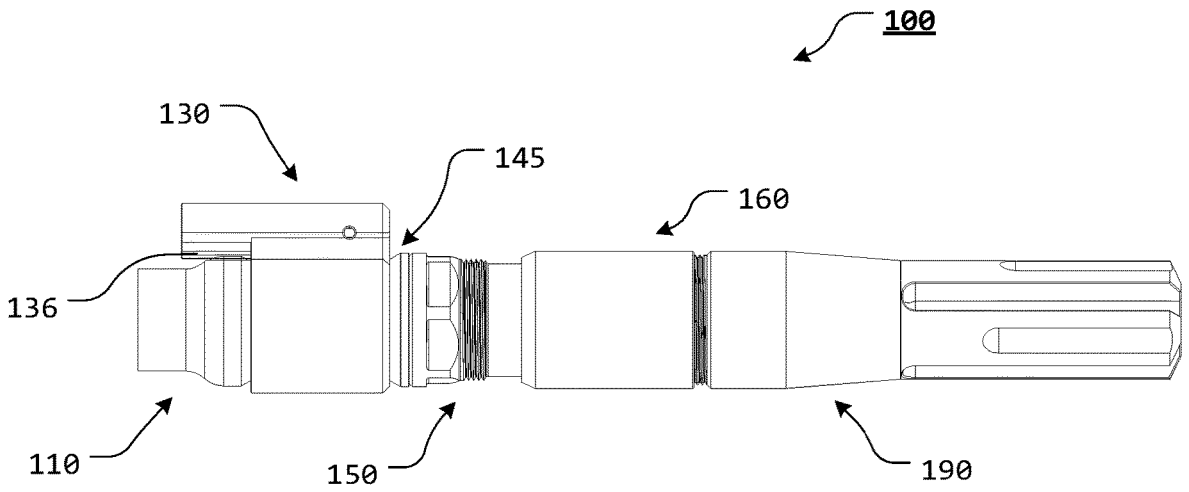
FIG. 32 illustrates a right, side view of various exemplary components of the over barrel muzzle device attachment system assembled according to certain aspects of the presently disclosed systems, methods, and/or apparatuses.
Figure 33:
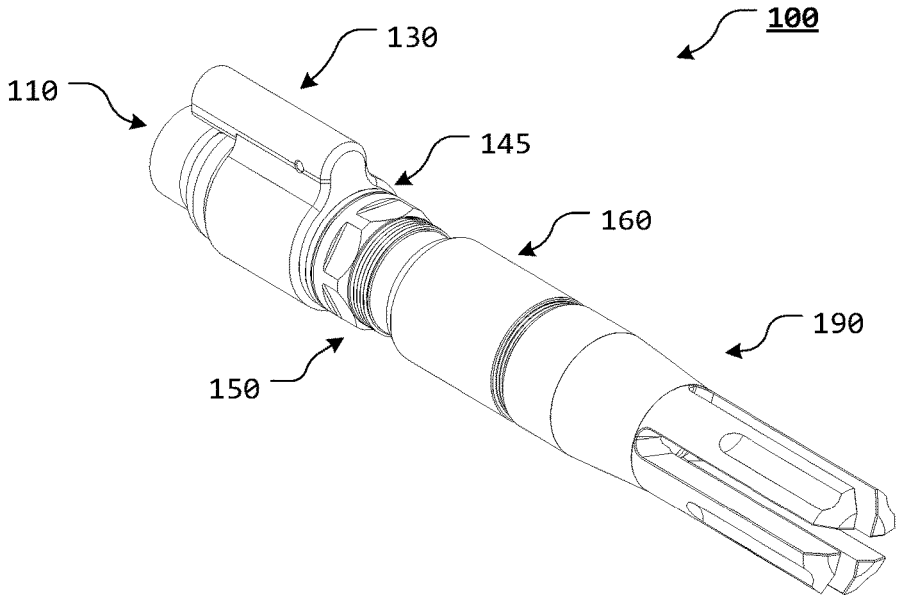
FIG. 33 illustrates an upper, front, perspective view of various exemplary components of the over barrel muzzle device attachment system assembled according to certain aspects of the presently disclosed systems, methods, and/or apparatuses.
Figure 34:
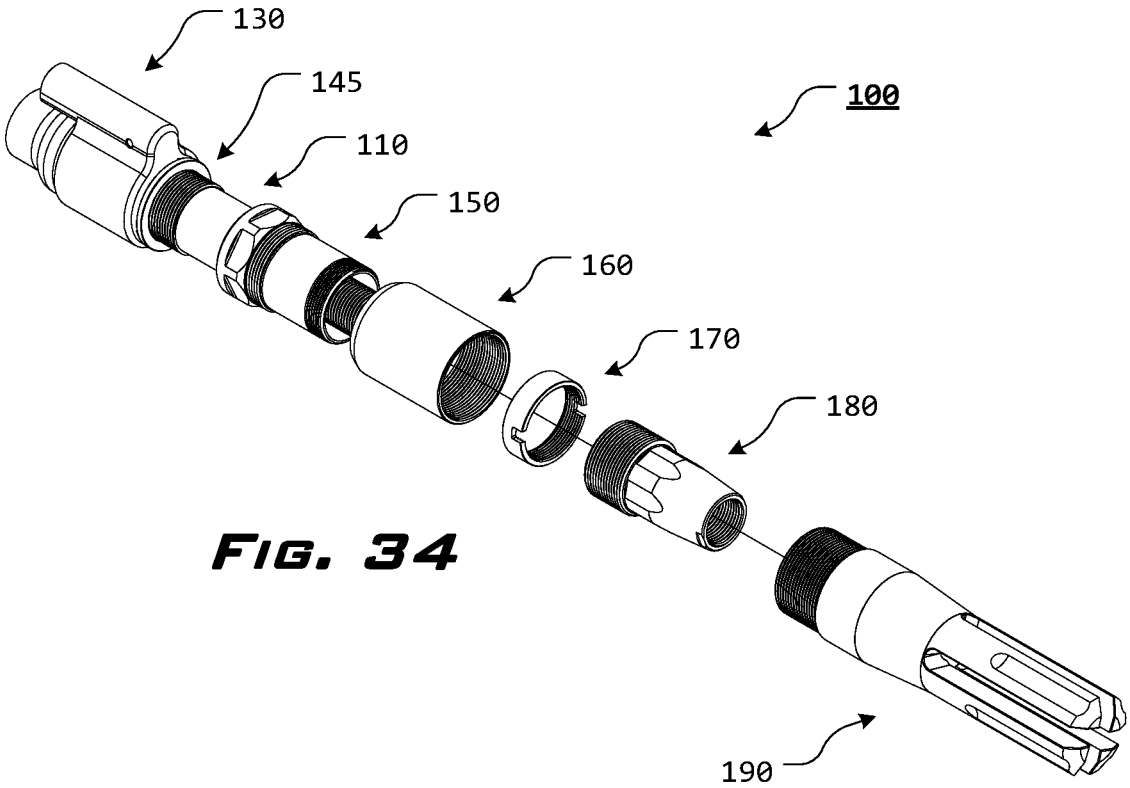
FIG. 34 illustrates an upper, front, perspective view of various exemplary components of the over barrel muzzle device attachment system aligned for assembly according to certain aspects of the presently disclosed systems, methods, and/or apparatuses.
Figure 35:
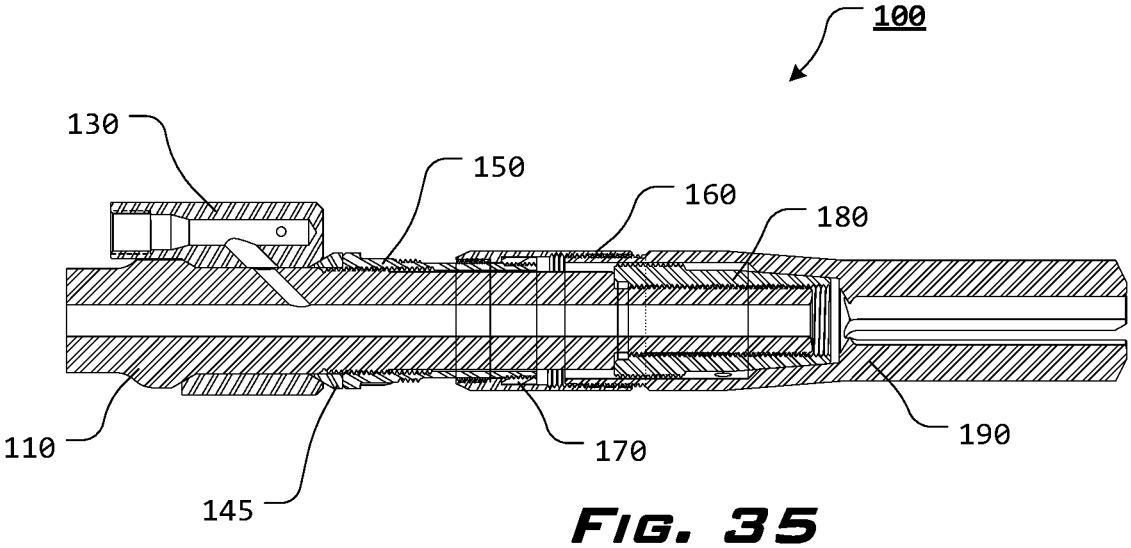
FIG. 35 illustrates right, side, cross-sectional view of various exemplary components of the over barrel muzzle device attachment system assembled according to certain aspects of the presently disclosed systems, methods, and/or apparatuses.

As illustrated most clearly in FIG. 17, the muzzle device adapter 180 comprises a muzzle device adapter aperture 183 extending from the adapter muzzle end 182 to the adapter barrel end 181. Muzzle device adapter aperture 183 includes an initial aperture portion 186 having a first inner diameter as the muzzle device adapter aperture 183 extends from the adapter barrel end 181, toward the adapter muzzle end 182. An inner adapter aperture shoulder 187 is formed within the muzzle device adapter aperture 183 and the muzzle device adapter aperture 183 has a second, smaller, inner diameter, within an adapter internally threaded aperture portion 184, as the muzzle device adapter aperture 183 extends from the inner adapter aperture shoulder 187 to the adapter muzzle end 182.

Muzzle device adapter threads are formed within the adapter internally threaded aperture portion 184 of the muzzle device adapter aperture 183, extending from the inner adapter aperture shoulder 187, toward or to the adapter muzzle end 182 of the muzzle device adapter 180. The muzzle device adapter threads are formed so as to be threadedly attached to the external threads of the threaded muzzle device attachment area 115 of the barrel 110.

The over barrel muzzle device 190 comprises at least some of a muzzle device body or muzzle device body portion 193 that extends from a muzzle device attachment portion 194 to a muzzle device flash suppressor portion 196.

In various exemplary embodiments, the muzzle device body portion 193 comprises an elongate portion of substantially cylindrical material that extends along a longitudinal axis $A_L$ from a muzzle device first end 191 to a muzzle device second end 192. In certain exemplary embodiments, various components of the over barrel muzzle device 190, including the muzzle device body portion 193, are formed of steel. Alternate materials of construction of the various components of the muzzle device body portion 193 may include one or more of the following: stainless steel, aluminum, titanium, and/or other metals, as well as various alloys, combinations, and/or composites thereof. Thus, it should be understood that the material or materials used to form the over barrel muzzle device 190 is a design choice based on the desired appearance, strength, and functionality of the over barrel muzzle device 190.

While the muzzle device body portion 193 is shown and described as being substantially cylindrical in shape, it is to be distinctly understood that the body may comprise any shape. Thus, while a substantially cylindrical outer shape would allow for ease in manufacturing and would conform with the customary use of cylindrical shaped muzzle brakes, the shape of the muzzle device body portion 193 is not limited to being substantially cylindrical and, for example, may be substantially oval, oblong, triangular, square, rectangular hexagonal, octagonal, etc.

The over barrel muzzle device 190 extends from a muzzle device attachment portion 194, which is adapted to attach to the lock collar, to a muzzle device flash suppressor portion 196 that extends beyond the muzzle device attachment portion 194.

A central muzzle device borehole 197 extends through the muzzle device body portion 193, generally along the longitudinal axis $A_L$ of the muzzle device body portion 193. The central muzzle device borehole 197 has a central muzzle device borehole 197 diameter $D_{CBA}$. Typically, the central muzzle device borehole 197 diameter $D_{CBA}$ is sufficient to allow the caliber of round with which the over barrel muzzle device 190 is to be utilized to safely pass through the central muzzle device borehole 197. Thus, it should be appreciated that the diameter $D_{CBA}$ of the central muzzle device borehole 197 is a design choice based upon the size of the projectile or caliber of weapon or other device with which the over barrel muzzle device 190 is to be utilized.

An externally threaded portion 195 extends along an exterior portion of the muzzle device attachment portion 194 from the muzzle device first end 191. The external threads of the externally threaded portion 195 our adapted to interact with the first internally threaded portion 166 of the lock collar 160 and allow the over barrel muzzle device 190 to be threadedly attached to the lock collar 160. It should be appreciated that the threads may be right-hand threads or left-hand threads.

In certain exemplary embodiments, the muzzle device flash suppressor portion 196 of the muzzle device body portion 193 includes longitudinally extending slots 198 that form or define forwardly extending elongated members or prongs 199. Each prong 199 is offset from and separated from each adjacent prong 199 by the longitudinally extending slots 198.

In certain exemplary, nonlimiting embodiments, as illustrated herein, the muzzle device flash suppressor portion 196 includes four longitudinally extending slots 198 defining four prongs 199. However, it should be appreciated that the muzzle device flash suppressor portion 196 may comprise a greater or lesser number of longitudinally extending slots 198 and prongs 199. Thus, the number of longitudinally extending slots 198 and prongs 199 is a design choice based upon the desired functionality and/or appearance of the over barrel muzzle device 190.

It should also be appreciated that the over barrel muzzle device 190 may take any desired shape or form and may optionally act as a flash suppressor, flash hider, muzzle brake, sound suppressor, or the like.

During installation of the muzzle device attachment system 100, as illustrated most clearly in FIGS. 20-35, the gas block 130 is positioned such that the barrel muzzle end 112 of the barrel 110 is urged through the gas block barrel borehole 139 and the barrel muzzle end 112 of the barrel 110 is positioned through the gas block proximal end 131 of the gas block barrel borehole 139 and the gas block 130 is urged over the barrel 110 until the tapered proximal shoulder 137 of the gas block 130 contacts the barrel conical shoulder 125 of the barrel projection shoulder 123. In this manner, the gas block 130 is positioned substantially over the gas block attachment area 118 of the barrel 110, such that the gas block gas port 141 is in fluid communication with the barrel gas port 120.

If included, the extension alignment protrusion 136 is aligned with the barrel projection notch 124.

Next, the barrel muzzle end 112 of the barrel 110 is positioned through the gas block compression ring aperture 146 of the gas block compression ring 145 and the gas block compression ring 145 is urged towards the gas block 130 such that the compression ring tapered portion 147 of the gas block compression ring 145 is urged against the tapered distal shoulder 138 of gas block 130.

The barrel muzzle end 112 is then urged through the gas block nut aperture 154 of the gas block nut 150. The gas block nut 150 is urged towards the gas block 130 until the internally threaded portion 158 is able to interact with the external threads of the gas block nut attachment area 119 of the barrel 110. Rotation of the gas block nut 150 relative to the barrel 110 causes between the internally threaded portion 158 and the externally threaded portion of the gas block nut attachment area 119, which allows the gas block nut 150 to be threadedly attached or coupled to the barrel 110 such that the gas block compression ring 145 contacts the first gas block nut end 151 of the gas block nut 150 and is urged toward the gas block 130. Appropriate rotational torque is applied to the gas block nut body 153 so as to urge the gas block 130 against the barrel projection shoulder 123 and the gas block compression ring 145 against the gas block 130.

The barrel muzzle end 112 of the barrel 110 is then urged through the lock collar aperture 164 of the lock collar 160. If the lock collar 160 is to be in a retracted position, the internal threads of the second internally threaded portion 168 are able to interact with the external threads of the second externally threaded portion 156 of the gas block nut 150. If the lock collar 160 is to be in an extended position, the internal threads of the second internally threaded portion 168 do not interact with the external threads of the second externally threaded portion 156 of the gas block nut 150 and the lock collar 160 slides along the gas block nut body 153 until the internal lock collar shoulder 165 contacts the gas block lock ring proximal end 171 of the gas block lock ring 170.

The barrel muzzle end 112 is then urged through the internally threaded gas block lock ring aperture 175 of the gas block lock ring 170. Interaction between the internal threads of the internally threaded gas block lock ring aperture 175 and the external threads of the first externally threaded portion 155 of the gas block nut 150 allow the gas block lock ring 170 to be threadedly attached or coupled to the gas block nut 150, such that the gas block lock ring proximal end 171 is abutted against the internal lock collar shoulder 165 of the lock collar 160. In this position, the lock collar 160 may be moved between a retracted position and extended position, relative to the gas block nut 150.

The barrel muzzle end 112 is then aligned with the threaded aperture portion 184 of the muzzle device adapter 180. Interaction between the external threads of the muzzle device attachment area 115 of the barrel 110 and the internal threads of the threaded aperture portion 184 of the muzzle device adapter 180 allow the muzzle device adapter 180 to be threadedly attached or coupled within the muzzle device attachment area 115 of the barrel 110. Typically, the muzzle device adapter 180 is attached or coupled such that the adapter barrel and 181 of the muzzle device adapter 180 is in contact with the muzzle device shoulder 116 of the barrel 110. In various exemplary embodiments, one or more shims may be positioned around the threaded muzzle device attachment area 115, between the adapter barrel end 181 of the muzzle device adapter 180 and the barrel projection shoulder 123. As a muzzle device adapter 180 is rotationally installed on the barrel 110, the one or more shims may be abutted between the adapter barrel end 181 of the muzzle device adapter 180 and the muzzle device shoulder 116 of the barrel 110. By including one or more shims, if needed, the rotational position of the muzzle device adapter 180, relative to the barrel 110, may be controlled and/or the muzzle device adapter 180 may be torqued to a desired specification.

A desired over barrel muzzle device 190 may then be attached or coupled to the barrel 110. To do this, the adapter muzzle end 182 of the muzzle device adapter 180 is aligned with the muzzle device first end 191 and positioned at least partially within the central muzzle device borehole 197. The conical taper portion 185 of the muzzle device adapter 180 is urged into the central muzzle device borehole 197 until appropriate surface contact is made between at least a portion of the external surface of the conical taper portion 185 and at least a portion of one or more internal surfaces of the central muzzle device borehole 197.

When the over barrel muzzle device 190 is appropriately positioned relative to the muzzle device adapter 180, the lock collar 160 is urged, from a retracted position, towards the over barrel muzzle device 190. As the lock collar 160 is urged towards the over barrel muzzle device 190, the external threads of the externally threaded portion 195 and the internal threads of the first internally threaded portion 166 interact such that rotational movement of the lock collar 160 relative to the over barrel muzzle device 190 causes the over barrel muzzle device 190 to be drawn toward the muzzle device adapter 180. Thus, as the lock collar 160 moves to the extended position, the over barrel muzzle device 190 is attached or coupled to the muzzle device adapter 180 and the barrel 110.

While the presently disclosed systems, methods, and/or apparatuses have been described in conjunction with the exemplary embodiments outlined above, the foregoing description of exemplary embodiments of the present disclosure, as set forth above, are intended to be illustrative, not limiting and the fundamental systems, methods, and/or apparatuses should not be considered to be necessarily so constrained. It is evident that the systems, methods, and/or apparatuses are not limited to the particular variation or variations set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belong.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An over barrel muzzle device attachment system, comprising:

a barrel extending from a barrel chamber end to a barrel muzzle end;

a gas block nut formed of a gas block nut body, extending from a first gas block nut end to a second gas block nut end and having a gas block nut aperture extending therethrough, wherein a first externally threaded portion extending from said second gas block nut end, a second externally threaded portion formed at a spaced apart location from said first externally threaded portion, and an internally threaded portion extending from said first gas block nut end, within at least a portion of said gas block nut aperture;

a lock collar formed of a lock collar body, extending from a first lock collar end to a second lock collar end and having a lock collar aperture extending therethrough, wherein a first internally threaded portion extending from a second lock collar end into at least a portion of a lock collar aperture and a second internally threaded portion extending from a first lock collar end into at least a portion of said lock collar aperture, wherein an internal lock collar shoulder is formed within a portion of said lock collar aperture, between said first internally threaded portion and said second internally threaded portion;

a gas block lock ring having an at least partially internally threaded gas block lock ring aperture formed within at least a portion of a gas block lock ring aperture;

a muzzle device adapter having a conical taper portion extending from an adapter muzzle end and a threaded portion extending along a portion of said muzzle device adapter, between said adapter muzzle end and an adapter barrel end; and an over barrel muzzle device having an externally threaded portion extending, from a muzzle device first and, along an exterior portion of said over barrel muzzle device.

2. The over barrel muzzle device attachment system of claim 1, wherein said lock collar is movable between a retracted position and an extended position, relative to said gas block nut, wherein said lock collar is able to be threadedly attached to said gas block nut in said retracted position, and wherein said lock collar is able to be threadedly attached to said gas block nut in said extended position.

3. The over barrel muzzle device attachment system of claim 1, further comprising a substantially circumferential barrel projection extending around an outer circumference of said barrel body, extending from a barrel projection shoulder, wherein said barrel projection shoulder extends from a gas block attachment area of said barrel toward said barrel chamber end, and wherein a barrel projection notch is formed in a portion of said barrel projection.

4. The over barrel muzzle device attachment system of claim 3, wherein an extension alignment protrusion extends from a gas block so as to be alignable with at least a portion of said barrel projection notch of said gas block.

5. The over barrel muzzle device attachment system of claim 1, further comprising a gas block having a gas block body portion and a gas block portion, wherein said gas block body portion extends from a gas block proximal end to a gas block distal end and includes a gas block barrel borehole extending therethrough, wherein a tapered proximal shoulder is formed in said gas block proximal end of said gas block barrel borehole, wherein said tapered proximal shoulder is mateable with said barrel conical shoulder to form an at least partial gas seal between said gas block and said barrel, wherein a tapered distal shoulder is formed in said gas block distal end of said gas block barrel borehole wherein said tapered distal shoulder is mateable with a compression ring tapered portion of a gas block compression ring to form an at least partial gas seal between said gas block and said gas block compression ring, wherein said gas block portion extends from said gas block body portion and includes a gas block gas port and a gas tube borehole, wherein an extension alignment protrusion extends from said gas block portion so as to be alignable with at least a portion of said barrel projection notch of said gas block, wherein a gas tube borehole extends from said gas block proximal end of said gas block extension portion and into at least a portion of said gas block extension portion, wherein a gas block gas port is disposed between said gas block barrel borehole and said gas tube borehole.

6. The over barrel muzzle device attachment system of claim 5, wherein at least a portion of said gas block extension portion extends beyond at least a portion of said gas block portion and said gas block body portion.

7. An over barrel muzzle device attachment system, comprising:

an elongate barrel having a barrel body and extending, along a longitudinal axis, from a barrel chamber end to a barrel muzzle end, wherein a barrel borehole is formed through said barrel body, along said longitudinal axis, wherein said barrel includes a threaded muzzle device attachment area within a reduced diameter portion of said barrel body that extends from said barrel muzzle end of said barrel to a muzzle device shoulder, which extends between said reduced diameter portion of said barrel body and a subsequent portion of said barrel body, wherein said threaded muzzle device attachment area includes muzzle threads that extend, within said threaded muzzle device attachment area, from said barrel muzzle end of said barrel, toward said barrel chamber end of said barrel, an externally threaded gas block nut attachment area, comprising external gas block nut threads, is spaced apart from said muzzle device shoulder and extends toward said barrel chamber end, a gas block attachment area extending from said gas block nut attachment area toward said barrel chamber end, wherein said gas block attachment area has an outer diameter formed so as to allow at least a portion of a gas block barrel borehole of a gas block to be slidably positioned around at least a portion of said gas block attachment area, wherein a barrel gas port is formed within said gas block attachment area to provide fluid communication between said barrel borehole and an exterior surface of said barrel body, a substantially circumferential barrel projection extending around an outer circumference of said barrel body, extending from a barrel projection shoulder, wherein said barrel projection shoulder extends from said gas block attachment area toward said barrel chamber end, and wherein a barrel projection notch is formed in a portion of said barrel projection;

a gas block having a gas block body portion and a gas block portion, wherein said gas block body portion extends from a gas block proximal end to a gas block distal end and includes a gas block barrel borehole extending therethrough, wherein a tapered proximal shoulder is formed in said gas block proximal end of said gas block barrel borehole, wherein said tapered proximal shoulder is mateable with said barrel conical shoulder to form an at least partial gas seal between said gas block and said barrel, wherein a tapered distal shoulder is formed in said gas block distal end of said gas block barrel borehole wherein said tapered distal shoulder is mateable with a compression ring tapered portion of a gas block compression ring to form an at least partial gas seal between said gas block and said gas block compression ring, wherein said gas block portion extends from said gas block body portion and includes a gas block gas port and a gas tube borehole, wherein an extension alignment protrusion extends from said gas block portion so as to be alignable with at least a portion of said barrel projection notch of said gas block, wherein a gas tube borehole extends from said gas block proximal end of said gas block extension portion and into at least a portion of said gas block extension portion, wherein a gas block gas port is disposed between said gas block barrel borehole and said gas tube borehole, such that said gas block barrel borehole is in fluid communication with said gas tube borehole, via said gas block gas port, and wherein said barrel gas port is alignable with said gas block gas port such that said barrel borehole, said barrel gas port, said gas block gas port, and said gas tube borehole may be in fluid communication;

a gas block nut formed of a gas block nut body, extending from a first gas block nut end to a second gas block nut end and having a gas block nut aperture extending therethrough, wherein a first externally threaded portion extending from said second gas block nut end, a second externally threaded portion formed at a spaced apart location from said first externally threaded portion, and an internally threaded portion extending from said first gas block nut end, within at least a portion of said gas block nut aperture;

a lock collar formed of a lock collar body, extending from a first lock collar end to a second lock collar end and having a lock collar aperture extending therethrough, wherein a first internally threaded portion extending from a second lock collar end into at least a portion of a lock collar aperture and a second internally threaded portion extending from a first lock collar end into at least a portion of said lock collar aperture, wherein said lock collar aperture has a first inner diameter within at least a portion of said first internally threaded portion and a second, smaller, inner diameter, within at least a portion of said second internally threaded portion, wherein an internal lock collar shoulder is formed within a portion of said lock collar aperture, between said first internally threaded portion and said second internally threaded portion;

a gas block lock ring having an at least partially internally threaded gas block lock ring aperture formed within at least a portion of a gas block lock ring aperture;

a muzzle device adapter having a conical taper portion extending from an adapter muzzle end and a threaded portion extending along a portion of said muzzle device adapter, between said adapter muzzle end and an adapter barrel end; and an over barrel muzzle device having an externally threaded portion extending, from a muzzle device first and, along an exterior portion of said over barrel muzzle device.

8. The over barrel muzzle device attachment system of claim 7, wherein said barrel conical shoulder forms a transition surface between said gas block attachment area and a portion of said barrel projection shoulder.

9. The over barrel muzzle device attachment system of claim 7, wherein said barrel conical shoulder has a surface portion formed at a 30° angle or a 150° angle relative to said barrel borehole of said barrel.

10. The over barrel muzzle device attachment system of claim 7, wherein said barrel projection notch is formed in a top dead center or 12 o'clock alignment position of said barrel.

11. The over barrel muzzle device attachment system of claim 7, wherein said barrel projection notch is formed such that interaction between at least a portion of said extension alignment protrusion and at least a portion of said barrel projection notch assists in maintaining said gas block in a desired rotational position relative to said barrel.

12. The over barrel muzzle device attachment system of claim 7, wherein said barrel gas port is formed at a 25° angle, a 45° angle, a 65° angle, a 135° angle, a 115° angle, or a 155° angle relative to said longitudinal axis of said barrel borehole.

13. The over barrel muzzle device attachment system of claim 7, wherein said barrel gas port is formed at an acute, 90°, or obtuse angle relative to said longitudinal axis of said barrel borehole.

14. The over barrel muzzle device attachment system of claim 7, wherein said gas block compression ring comprises a gas block compression ring aperture formed therethrough and includes a compression ring tapered portion.

15. The over barrel muzzle device attachment system of claim 7, wherein at least a portion of said gas block extension portion extends beyond at least a portion of said gas block portion and said gas block body portion.

16. A barrel for an over barrel muzzle device attachment system, comprising:

an elongate barrel having a barrel body and extending, along a longitudinal axis, from a barrel chamber end to a barrel muzzle end, wherein a barrel borehole is formed through said barrel body, along said longitudinal axis;

a threaded muzzle device attachment area formed within a reduced diameter portion of said barrel body that extends from said barrel muzzle end of said barrel to a muzzle device shoulder, which extends between said reduced diameter portion of said barrel body and a subsequent portion of said barrel body, wherein said threaded muzzle device attachment area includes muzzle threads that extend, within said threaded muzzle device attachment area, from said barrel muzzle end of said barrel, to said muzzle device shoulder;

an externally threaded gas block nut attachment area, comprising external gas block nut threads, is spaced apart from said muzzle device shoulder and extends toward said barrel chamber end;

a gas block attachment area extending from said gas block nut attachment area toward said barrel chamber end, wherein said gas block attachment area has an outer diameter formed so as to allow at least a portion of a gas block barrel borehole of a gas block to be slidably positioned around at least a portion of said gas block attachment area, wherein a barrel gas port is formed within said gas block attachment area to provide fluid communication between said barrel borehole and an exterior surface of said barrel body; and a substantially circumferential barrel projection extending around an outer circumference of said barrel body, extending from a barrel projection shoulder, wherein said barrel projection shoulder extends from said gas block attachment area toward said barrel chamber end, and wherein a barrel projection notch is formed in a portion of said barrel projection.

17. The barrel for an over barrel muzzle device attachment system of claim 16, wherein said barrel projection notch is formed in a top dead center or 12 o'clock alignment position of said barrel.

18. The barrel for an over barrel muzzle device attachment system of claim 16, wherein said gas block attachment area has a diameter of approximately 0.075 inches or approximately 0.080 inches.

19. The barrel for an over barrel muzzle device attachment system of claim 16, wherein said barrel gas port is formed at a 25° angle, a 45° angle, a 65° angle, a 135° angle, a 115° angle, or a 155° angle relative to said longitudinal axis of said barrel borehole.

20. The barrel for an over barrel muzzle device attachment system of claim 16, wherein said barrel gas port is formed at an acute, 90°, or obtuse angle relative to said longitudinal axis of said barrel borehole.

* * * * *